US006422407B2

(12) United States Patent
Arai

(10) Patent No.: US 6,422,407 B2
(45) Date of Patent: Jul. 23, 2002

(54) ARTICLE TRANSPORTING/STORING APPARATUS

(75) Inventor: Tomoaki Arai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/725,444

(22) Filed: Nov. 30, 2000

(30) Foreign Application Priority Data

Nov. 30, 1999 (JP) ..... 11-339252

(51) Int. Cl.[7] ..... A47F 5/00

(52) U.S. Cl. ..... 211/189; 211/187; 211/207; 211/175; 211/108; 211/55.1

(58) Field of Search ..... 211/187, 207, 211/208, 175, 201, 186, 189; 108/55.1, 54.1; 280/79.3

(56) References Cited

U.S. PATENT DOCUMENTS

| | | | | |
|---|---|---|---|---|
| RE13,395 E | * | 4/1912 | Shek | |
| 1,272,175 A | * | 7/1918 | Albright | |
| 2,459,024 A | * | 1/1949 | Gipson | |
| 3,082,711 A | * | 3/1963 | Vetere | |
| 3,533,502 A | * | 10/1970 | Hansen | |
| 3,788,242 A | * | 1/1974 | Hassel et al. | |
| 3,850,295 A | * | 11/1974 | Black | 211/175 X |
| 4,500,146 A | * | 2/1985 | Peterson | 211/175 X |
| 5,131,547 A | * | 7/1992 | Goldberg | 211/201 X |
| 5,233,931 A | * | 8/1993 | McCorkle | 108/55.1 |
| 5,234,116 A | * | 8/1993 | Kristinsson et al. | 211/201 |
| 6,036,034 A | * | 3/2000 | Battaglia et al. | 211/187 |
| 6,311,856 B2 | * | 11/2001 | Battaglia et al. | 211/187 |

FOREIGN PATENT DOCUMENTS

JP 11-348985 12/1999

* cited by examiner

*Primary Examiner*—Robert W. Gibson, Jr.
(74) *Attorney, Agent, or Firm*—Oblon, Spivak, McClelland, Maier & Neustadt, P.C.

(57) ABSTRACT

An article transporting/storing apparatus is provided for efficiently transporting or storing articles that are different in size, form or number. First and second coupling members crossing each other are disposed between each pair of adjacent posts such that a spacing therebetween can be freely changed. An article carrier is removably attached to the insides of the four posts for carrying articles on the article carrier.

17 Claims, 29 Drawing Sheets

ARTICLE TRANSPORTING/STORING APPARATUS

BACKGROUND OF THE INVENTION

1. Field of the Invention

The present invention relates to an article transporting/storing apparatus for carrying articles when the articles are transported or stored, or for any other purpose.

2. Description of the Related Art

Article transporting/storing apparatus for use in transporting a variety of articles or storing them have been conventionally known. Such articles include industrial products such as electric products, parts thereof, building materials, furniture, natural products, etc. A conventional article transporting/storing apparatus of this type is generally composed of a palette for carrying articles thereon; four posts fixed to four corners of the palette in an upright posture with respect to an article carrying surface of the palette; and coupling members for securely coupling adjacent posts with each other. For transporting or storing articles with such an article transporting/storing apparatus, the articles are accommodated in a space defined inside the four posts, and carried on the palette, such that the articles are transported or stored together with the article transporting/storing apparatus.

However, while articles subjected to transportation and storage with this type of article transporting/storing apparatus widely range from a large sized article to a small sized article, the above-mentioned conventional article transporting/storing apparatus has a fixed volume of the space available for accommodating articles. Therefore, although an article transporting/storing apparatus of a particular size may be used to transport or store an article of a size suitable to the article transporting/storing apparatus, an article of a size larger than the article accommodating space of the article transporting/storing apparatus cannot be accommodated therein, so that the article transporting/storing apparatus cannot be used to transport or store the article. On the other hand, if the article transporting/storing apparatus is used to transport or store an article extremely smaller than the article accommodating space, this will cause unfavorable results, such as a lower transportation efficiency, a wasteful use of the space available for installing the article transporting/storing apparatus, etc.

OBJECT AND SUMMARY OF THE INVENTION

It is therefore an object of the present invention to provide an article transporting/storing apparatus which eliminates the disadvantages of the conventional counterpart.

To achieve the above object, the present invention provides an article transporting/storing apparatus which includes a plurality of posts, a post coupling mechanism, and at least one article carrier. The post coupling mechanism is arranged and configured to couple adjacent posts to each other such that at least one spacing between the posts can be adjusted. The article carrier is supported by at least some of the plurality of posts.

The article transporting/storing apparatus advantageously may include the carrier holding mechanism through which the article carrier is supported by the posts, wherein the carrier holding mechanism is adapted to hold the article carrier at a different position in a longitudinal direction of the posts.

Also advantageously, the article carrier may removably attached to the posts.

Further advantageously, the carrier holding mechanism may include a carrier receiving member removably fixed to the post for supporting the article carrier from below.

Further advantageously, the carrier holding mechanism may include a carrier pressing member removably fixed to the post for pressing an upper surface of the article carrier.

Further advantageously, the article transporting/storing apparatus may further includes a positioning mechanism for positioning the article carrier with respect to the post.

Further advantageously, the article carrier may adjustably be configured such that a profile thereof is changed.

BRIEF DESCRIPTION OF THE DRAWINGS

A more complete appreciation of the present application and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
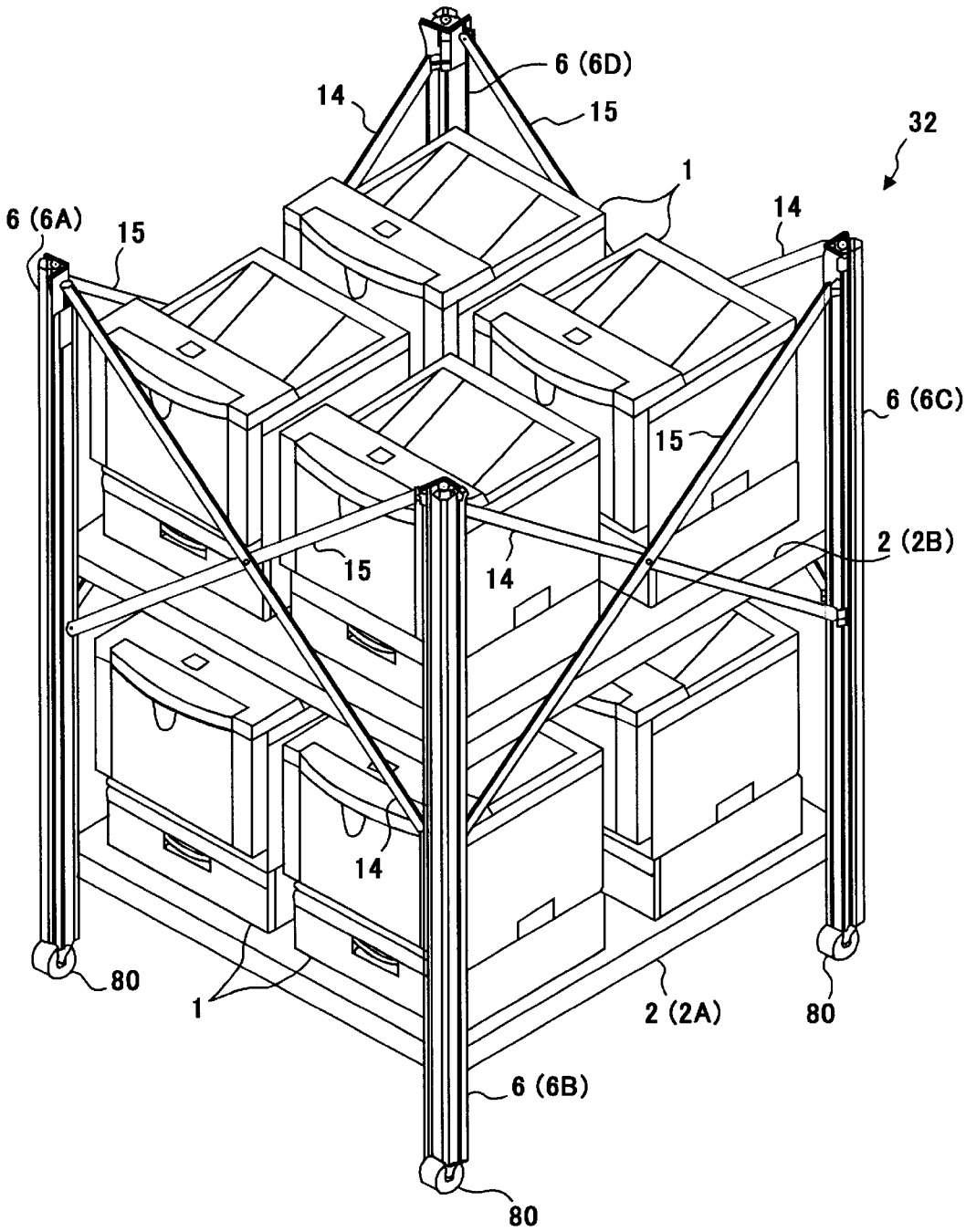
FIG. 1 is a perspective view illustrating an article transporting/storing apparatus according to one embodiment of the present invention.

The present invention will hereinafter be described in detail in connection with several embodiments thereof with reference to the accompanying drawings. In describing preferred embodiments illustrated in the drawings, specific terminology is employed for the sake of clarity. However, the invention is not intended to be limited to the specific terminology so selected and it is to be understood that each specific element includes all technical equivalents which operate in a similar manner.

Figure 2:
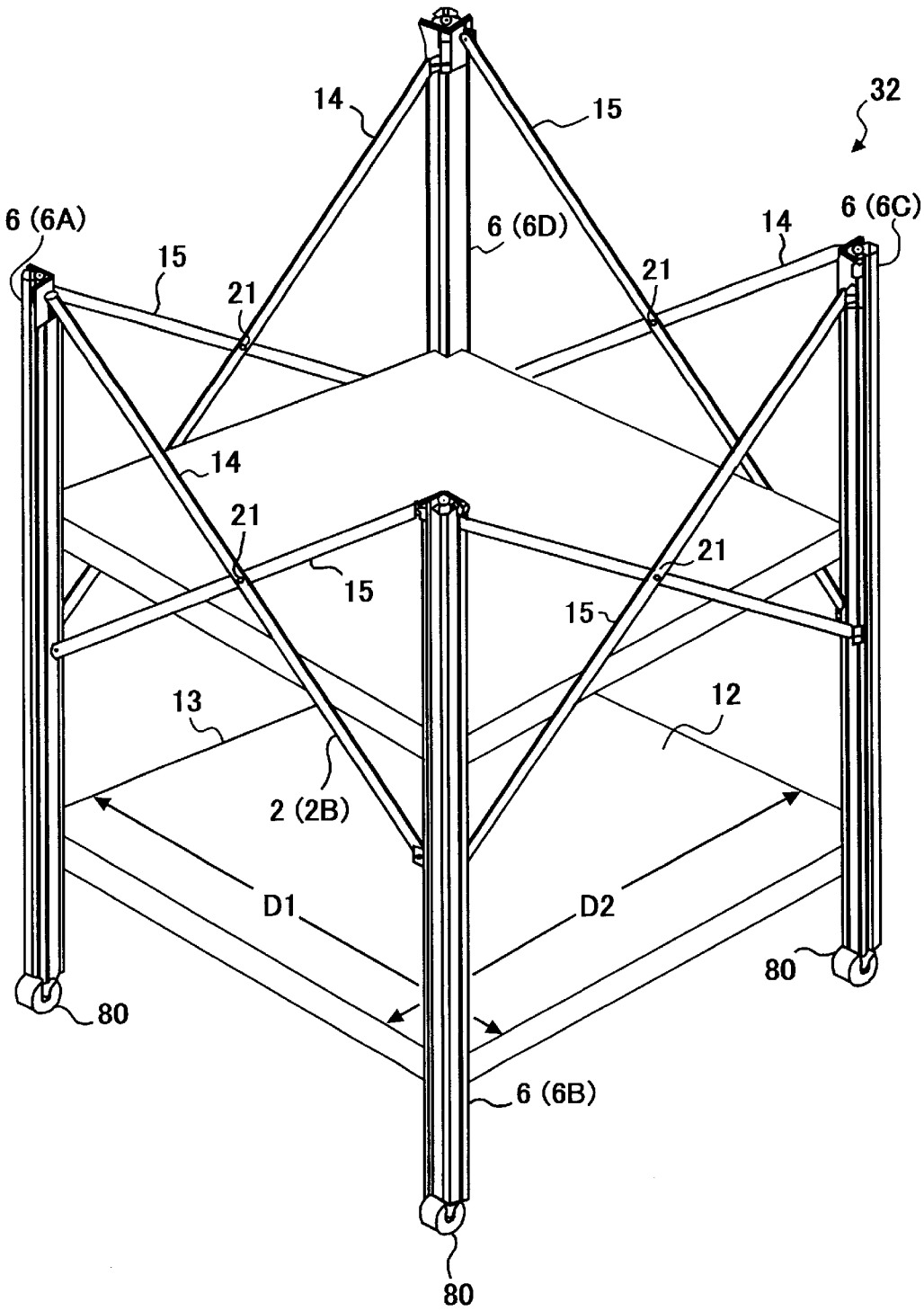
FIG. 2 is a perspective view of the article transporting/storing apparatus of FIG. 1 when no articles are carried on article carriers.

Referring now to the drawings, wherein like reference numeral designate identical or corresponding parts throughout the several views, particularly to FIGS. 1 and 2, an article transporting/storing apparatus according to one embodiment of the present invention is illustrated. The illustrated article transporting/storing apparatus, which is also referred to as an article holder, is provided for carrying articles for purposes of transporting the articles or temporarily or permanently storing the articles, or for other purposes.

The article transporting/storing apparatus illustrated herein has a plurality of posts 6 spaced apart from each other, and at least one article carrier 2 supported by these posts 6. The illustrated article transporting/storing apparatus has a pair of upper and lower article carriers 2 and four posts 6, wherein the posts 6 are arranged such that the respective posts 6 are positioned at respective comers of a quadrilateral (including, for example, a square or a rectangle), when these posts 6 are viewed from above. As illustrated in FIG. 1, the article carrier 2, is an element for supporting articles 1 carried thereon. In this embodiment, the article carrier 2 is formed substantially in a planar quadrilateral shape.

In other embodiments, article carriers of other shapes, for example, circular or elliptic article carriers may be employed. While FIG. 1 illustrates printers as an example of the articles 1 carried on the article carriers 2, a variety of other articles as previously mentioned as examples, such as other industrial products, parts thereof, or other articles may be carried on the article carriers 2. The article carriers 2 and the posts 6 are made of a material exhibiting a large rigidity such as metal, hard resin, wood or the like. It should be noted that when the four posts need be individually identified, they are referred to as a first post 6A, a second post 6B, a third post 6C and a fourth post 6D. Likewise, the two article carriers 2 are designated reference numerals 2A, 2B, respectively, such that they can be distinguished from each other as required.

Figure 3:
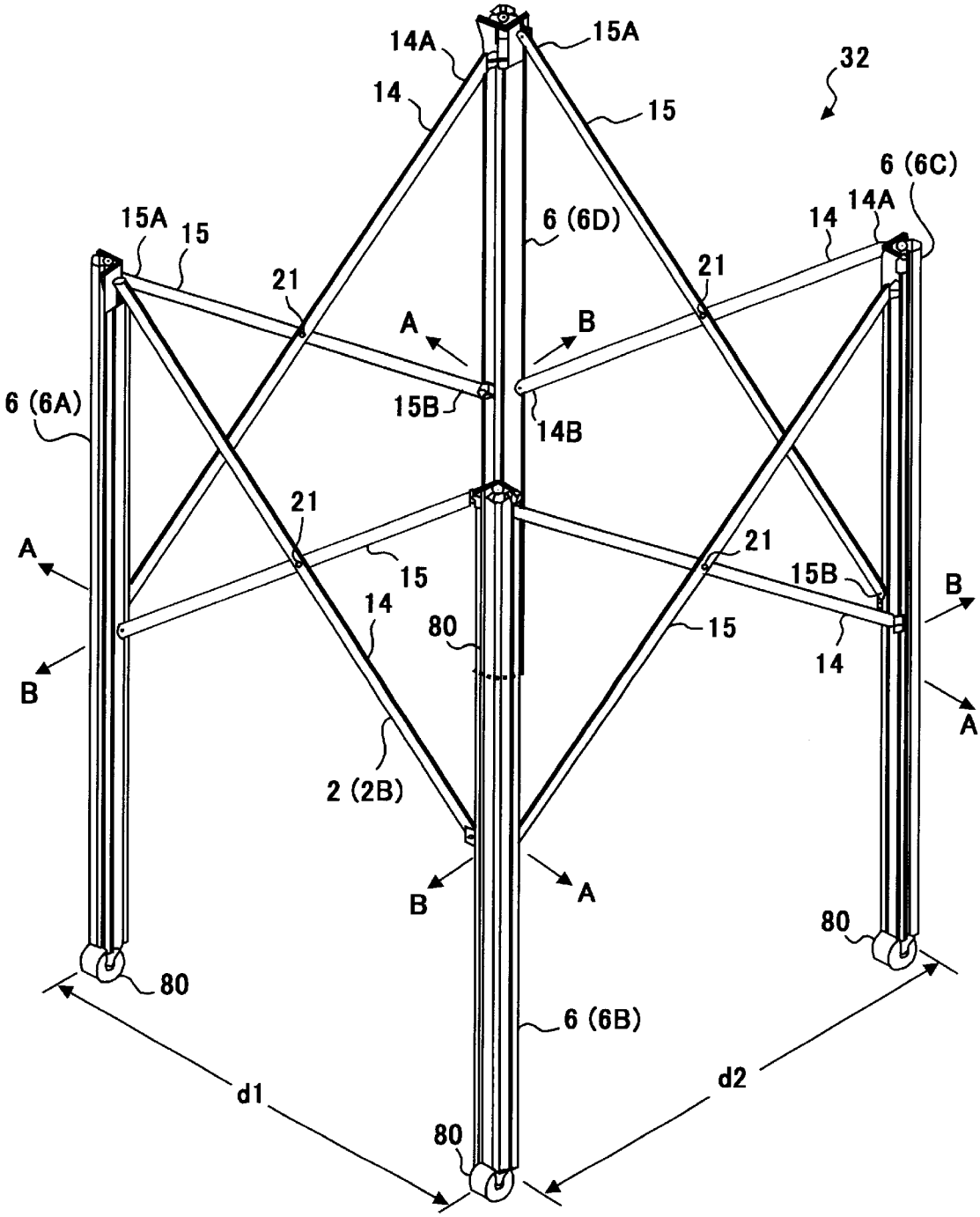
FIG. 3 is a perspective view of the article transporting/storing apparatus of FIG. 1 before the article carriers are attached to posts.

The article carriers 2 of this embodiment are removably attached to the posts 6. FIG. 3 illustrates the article transporting/storing apparatus of this embodiment before the article carriers 2 are attached to the posts 6. These posts 6 are assembled such that each pair of adjacent posts are coupled with each other by post coupling means, as described below.

Figure 4:
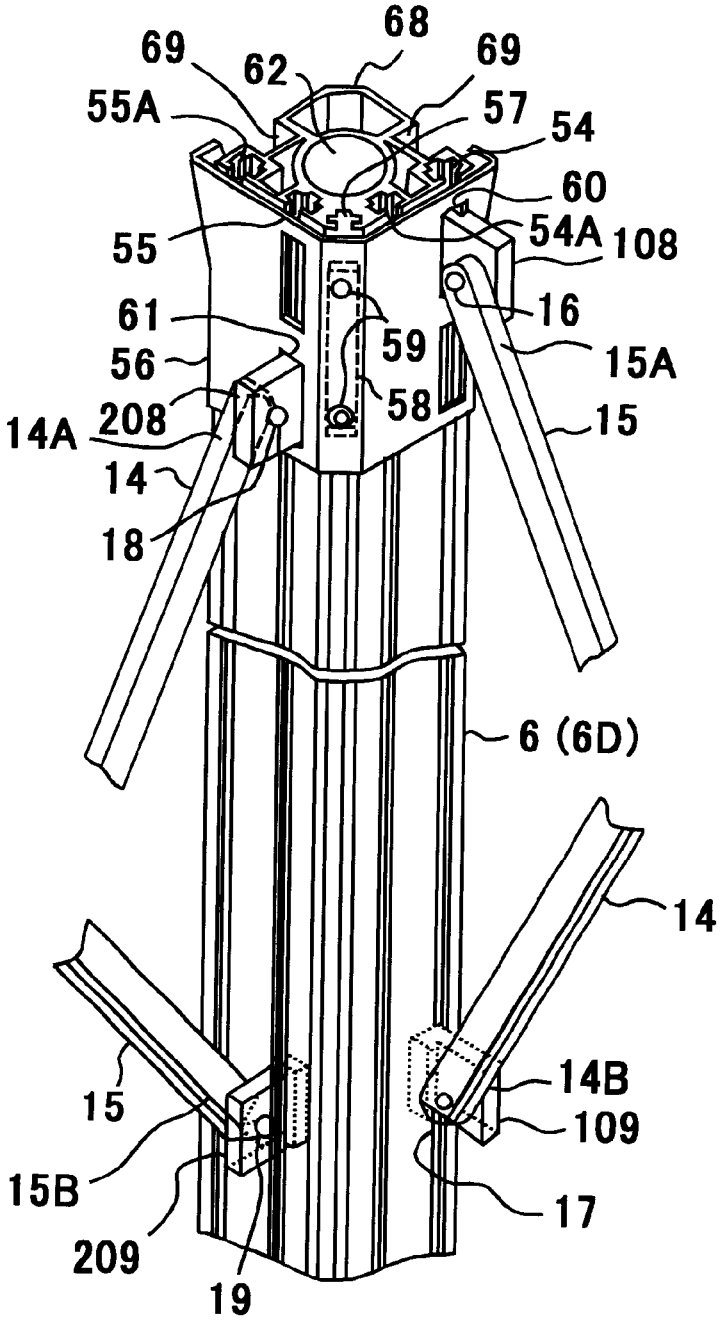
FIG. 4 is an enlarged perspective view illustrating in detail one post and joints attached thereto.
Figure 5:
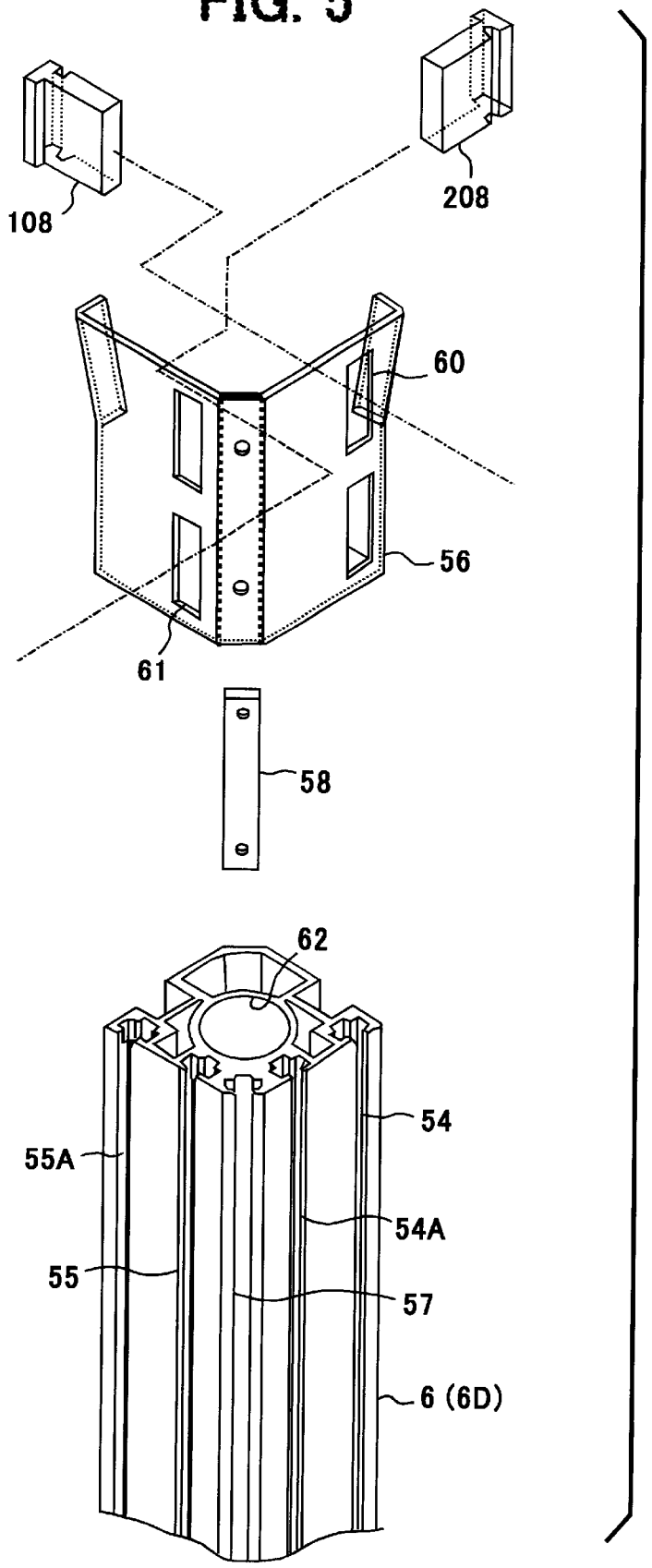
FIG. 5 is an exploded perspective view of the post illustrated in FIG. 4.

The post coupling means of this embodiment has first and second coupling members 14, 15 crossing each other between each pair of adjacent posts, and a joint for pivotably coupling each end of each coupling member 14, 15 to the post 6 associated therewith. FIG. 4 is an enlarged perspective view of the fourth post 6D and the joints attached thereto of the article transporting/storing apparatus, and FIG. 5 is an exploded perspective view of a portion of the structure illustrated in FIG. 4.

Referring specifically to these figures, the post 6 is formed with guide grooves 54, 55 which extend over the entire length of and in parallel with the post 6 in the longitudinal direction. A base of each first joint 108, 208 comprised of small parts is fitted in an upper end portion of the guide groove 54 or 55. The post 6 is also formed with another groove 57 on one comer thereof, which extends over the entire length of the post 6. A plate-shaped nut 58 is fitted in the groove 57 for slidable movement therealong. The two first joints 108, 208 and the nut 58 are inserted into the grooves 54, 55, 57 associated therewith from their upper end or lower end of the post 6. The first joints 108, 208 and the nut 58, once inserted, will not come off in the radial direction of the post 6 although they are slidable along the grooves 54, 55, 57.

A fixing member 56 made of metal or resin plate is attached to a top portion of the post 6, and the first joints 108, 208 are fitted respectively in throughholes 60, 61 formed through the fixing member 56 without back-lash. Screws 59 are inserted through two holes formed through the fixing member 56, and screwed into screw holes of the nuts 58 fitted in the grove 57, so that the two first joints 108, 208 are securely fixed to the post 6. Also, bases of second joints 109, 209 comprised of small parts are slidably fitted in the guide grooves 54, 55, respectively, without coming off in the radial direction of the post 6. A central hole 62 is formed through the entire length of the post 6 at the center of the post 6.

The remaining posts 6A, 6B, 6C illustrated in FIG. 3 are configured in a manner similar to the foregoing, and each pair of first joints and second joints are attached to the respective posts associated therewith substantially in a manner similar to the foregoing. Therefore, description on the structure of the remaining posts 6A, 6B, 6D and the structure of the first and second joints attached to the respective posts are omitted.

As illustrated in FIGS. 1 to 3, the first and second coupling members 14, 15 disposed between a pair of adjacent posts 6 are made of a rigid material, for example, metal, hard resin, wood or the like and formed in a linearly extending rod or narrow plate shape. The two coupling members 14, 15 are coupled by a pin 21 disposed in the middle for pivotal movements with respect to each other.

Considering now the adjacent third and fourth posts 6C, 6D and the first and second coupling members 14, 15 disposed between these posts 6C, 6D as illustrated in FIG. 3, one longitudinal end 15A on the upper side of the second coupling member 15 is pivotably coupled through the pin 16 to the first joint 108 of the two first joints 108, 208 securely attached to the fourth post 6D as described above, as illustrated in FIG. 4. Also, as can be seen from FIG. 3, the other longitudinal end 15B on the lower side of the second coupling member 15 is pivotably coupled through a pin 19 to one of two second joints slidably attached to the third post 6C.

On the other hand, a longitudinal end 14A on the upper side of the first coupling member 14 disposed between the third and fourth posts 6C, 6D is pivotably coupled through a pin 18 to one of two first joints fixedly attached to the third post 6C. Also, the other longitudinal end 14B on the lower side of the first coupling member 14 is pivotably coupled through a pin 17 to one (109) of the two second joints 109, 209 slidably attached to the fourth post 6D, as illustrated in FIG. 4.

Just in a similar manner, one longitudinal end 14A on the upper side of the first coupling member 14 disposed between the first and fourth posts 6A, 6D is pivotably coupled through a pin 18 to the other first joint 208 illustrated in FIG. 4. The other longitudinal end 14B on the lower side of the same first coupling member 14 is pivotably coupled through a pin 17 to one of second joints slidably attached to the first post 6A. Similarly, one longitudinal end 15A on the upper side of the second coupling member 15 is pivotably coupled through a pin 16 to one of first joints securely attached to the first post 6A. The other longitudinal end 15B on the lower side of the second coupling member 15 is pivotably coupled through a pin 19 to the other second joint 209 slidably attached to the fourth post 6D, as illustrated in FIG. 4.

First and second coupling members 14, 15 disposed between the adjacent first and second posts 6A, 6B and between the adjacent second and third posts 6B, 6C are also coupled to the respective posts associated therewith through first and second joints completely in a similar manner. Since their structures are apparent from the foregoing, detailed description thereon is omitted. It should be noted that the first and second coupling members 14, 15, which cross each other, are positioned slightly offset in the horizontal direction. Therefore, when the two coupling members 14, 15 are pivoted about the pin 21 as described later, the first and second joints, to which the associated ends of the respective coupling members 14, 15 are coupled, may be fitted into guide grooves 55A, 54A of the respective posts except for the post 6D in order to provide smooth pivotal movements of the coupling members 14, 15. These guide grooves 55A, 54A extend in parallel with the aforementioned guide grooves 54, 44 in the longitudinal direction of the post 6.

The article carrier 2 is attached to the four posts 6 in a manner described below. A variety of sizes of article carriers 2 have been previously provided corresponding to the size, form or number of the articles 1 intended for transportation or storage. Therefore, an article carrier 2 of a size suitable for the size, form and number of the particular articles 1 is selected and attached to the posts 6. In this event, as a selected article carrier 2 has sides of different lengths D1, D2 (FIG. 2) depending on its size, the spacings between the respective posts 6 are adjusted in the following manner so as to adapt to the lengths D1, D2.

Specifically, the first and second posts 6A, 6B and the third and fourth posts 6C, 6D, attached adjacent to a first side 10 of the article carrier 2 and a third side 12 opposite thereto, respectively, are pressed in a direction indicated by an arrow A in FIG. 3 in which the posts in each pair are spaced further away from each other, or in the direction opposite thereto. This causes the respective second joints 109 (FIG. 4), to which the other longitudinal ends on the lower sides of the first and second coupling members 14, 15 disposed between these posts are pivotably coupled, to slide upward or downward along the guide grooves of the respective posts.

The sliding movements of the second joints 109 produce pivotal movements of the first and second coupling members 14, 15 about the pin 21 with respect to each other to change a spacing d1 between the first and second posts 6A, 6B and a spacing d1 between the remaining third and fourth posts 6C, 6D in the same proportion. In this event, only the adjustments of the spacings between the posts 6A, 6B and between the posts 6C, 6D will not result in any change in a spacing d2 between the second and third posts 6B, 6C and a spacing d2 between the fourth and first posts 6D, 6A.

For adjusting the spacings d2, the second and third posts 6B, 6C and the fourth and first posts 6D, 6A are pressed in a direction indicated by an arrow B in FIG. 3 in which the posts in each pair are spaced further away from each other, or in the direction opposite thereto. This causes the respective second joints 209 (FIG. 4), to which the other ends on the lower sides of the respective coupling members 14, 15 are pivotably coupled, to slide upward or downward along the guide grooves of the respective posts. The sliding movements of the second joints 209 produce pivotal movements of the first and second coupling members 14, 15 about the pin 21 with respect to each other to change the spacing d2 between the second and third posts 6B, 6C and the spacing d2 between the first and fourth posts 6A, 6D in the same proportion.

As described above, the post coupling means for coupling a pair of posts with each other are configured to associatively adjust the spacing between the two posts 6 positioned adjacent to each other and the spacing between the remaining two posts 6 positioned opposite to the former pair of posts 6 and adjacent to each other, such that these spacings change in the same proportion. This structure makes the spacing between each pair of the posts freely adjustable.

As described above, a plurality of types of article carriers 2 having the sides 10, 11, 12, 13 of different lengths D1, D2 from one another have been previously provided, such that one article carrier 2 is selected for particular articles, and the spacing between each pair of the adjacent posts 6 can be adjusted to accommodate the lengths D1, D2 of the respective sides of the selected article carrier 2.

The selected article carrier 2 in turn may be attached to the respective posts 6 through carrier holding means in a manner described below.

Figure 6:
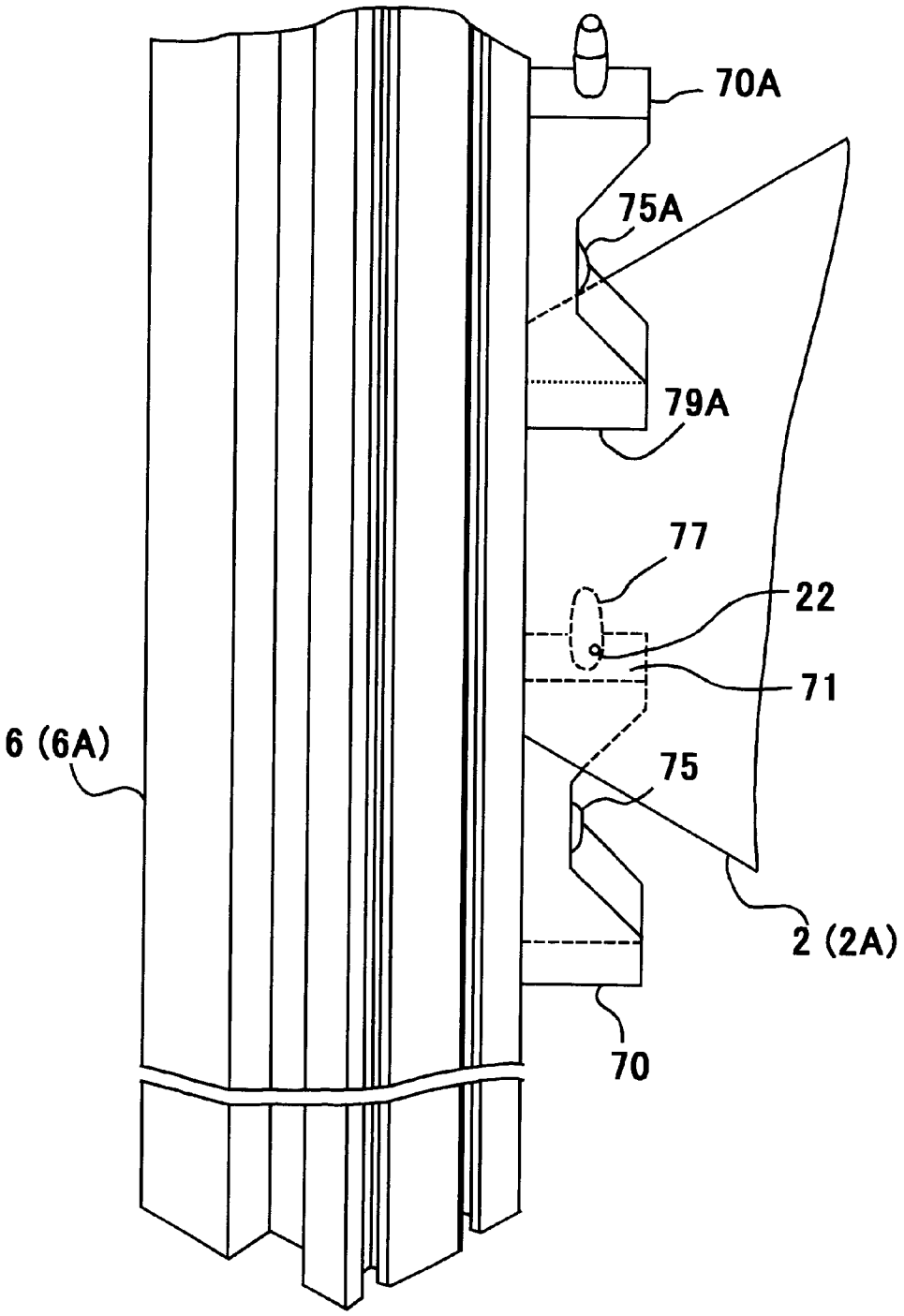
FIG. 6 is a perspective view illustrating how an article carrier is supported by a post through a carrier receiving member and a carrier pressing member.

The carrier holding means of this embodiment each have a carrier receiving member 70 for holding the respective comers of the article carrier 2 to the respective posts 6, and a base pressing member 70A. FIG. 6 illustrates exemplary carrier receiving member 70 and carrier pressing member 70A for attaching a comer of the article carrier 2 to the first post 6A. More specifically, FIG. 6 is an enlarged perspective view which is seen from the same direction as that in which the first post 6A is illustrated in FIG. 3.

Figure 7:
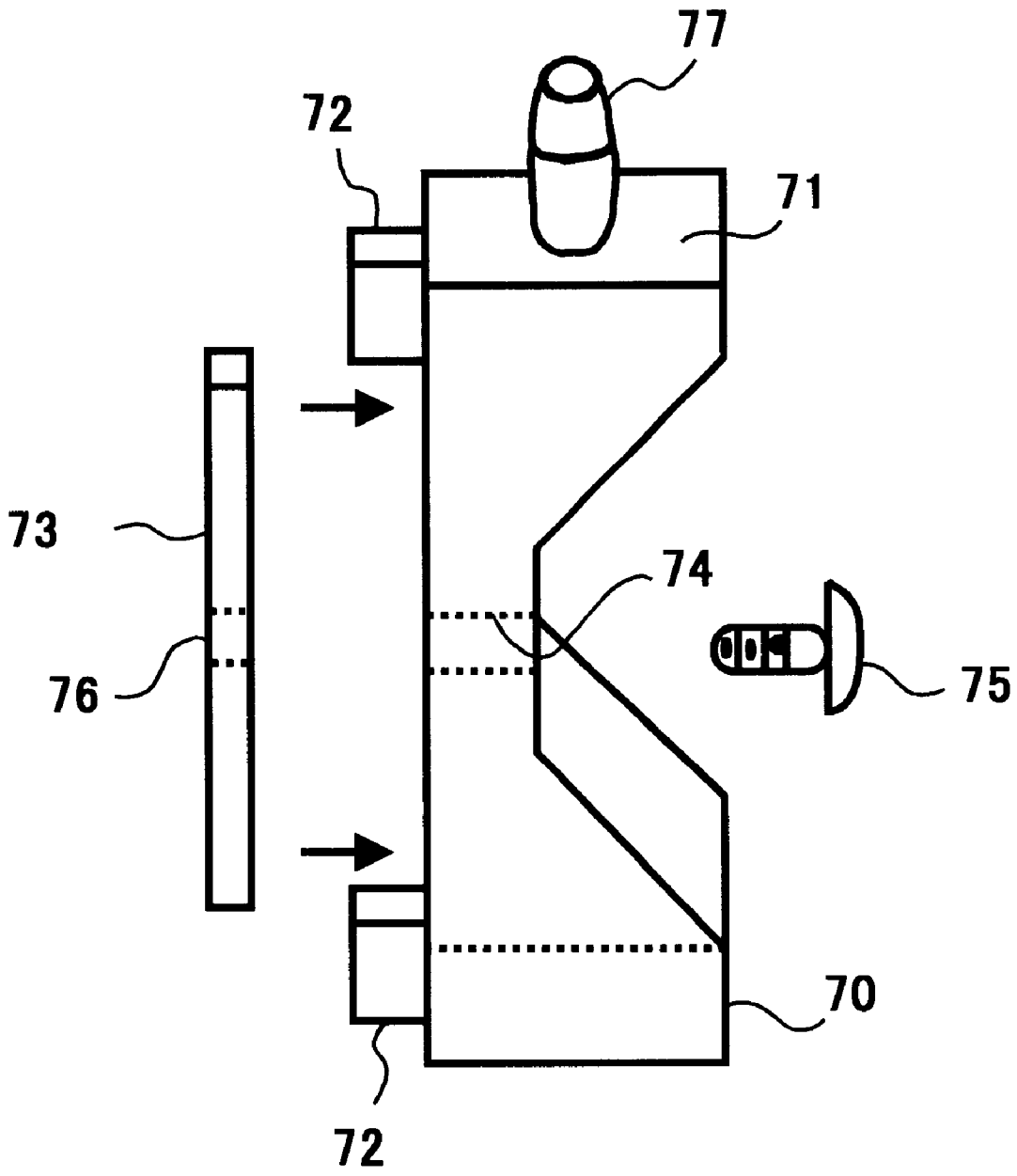
FIG. 7 is a perspective view of the carrier receiving member.

The carrier receiving member 70 illustrated in FIG. 6 is formed in a small block having a flat upper surface 71, as illustrated in FIG. 7, and is formed with a pair of upper and lower protrusions 72, on one side of the block, which are slidably and removably fitted in the aforementioned groove 57 (see FIG. 4) formed in the post 6A. Also, a nut 73 illustrated in FIG. 7 is fitted in the groove 57 of the post 6A slidably in the longitudinal direction of the post 6A. The nut 73 is also inserted into the groove 57 of the post 6A from the upper end or the lower end of the post 6A, and will not come off in the radial direction of the post 6A.

Here, the two protrusions 72 of the carrier receiving member 70 are fitted into the groove 57, and arranged such that the nut 73 fitted in the groove 57 is positioned between the upper and lower protrusions 72, as illustrated in FIG. 7. Next, a screw 75 is inserted into a hole 74 formed through the carrier receiving member 70, and screwed into a screw hole 76 of the nut 73 for securing the nut 73 on the carrier receiving member 70. In this way, the carrier receiving member 70 is removably fixed to the post 6A.

Figure 8:
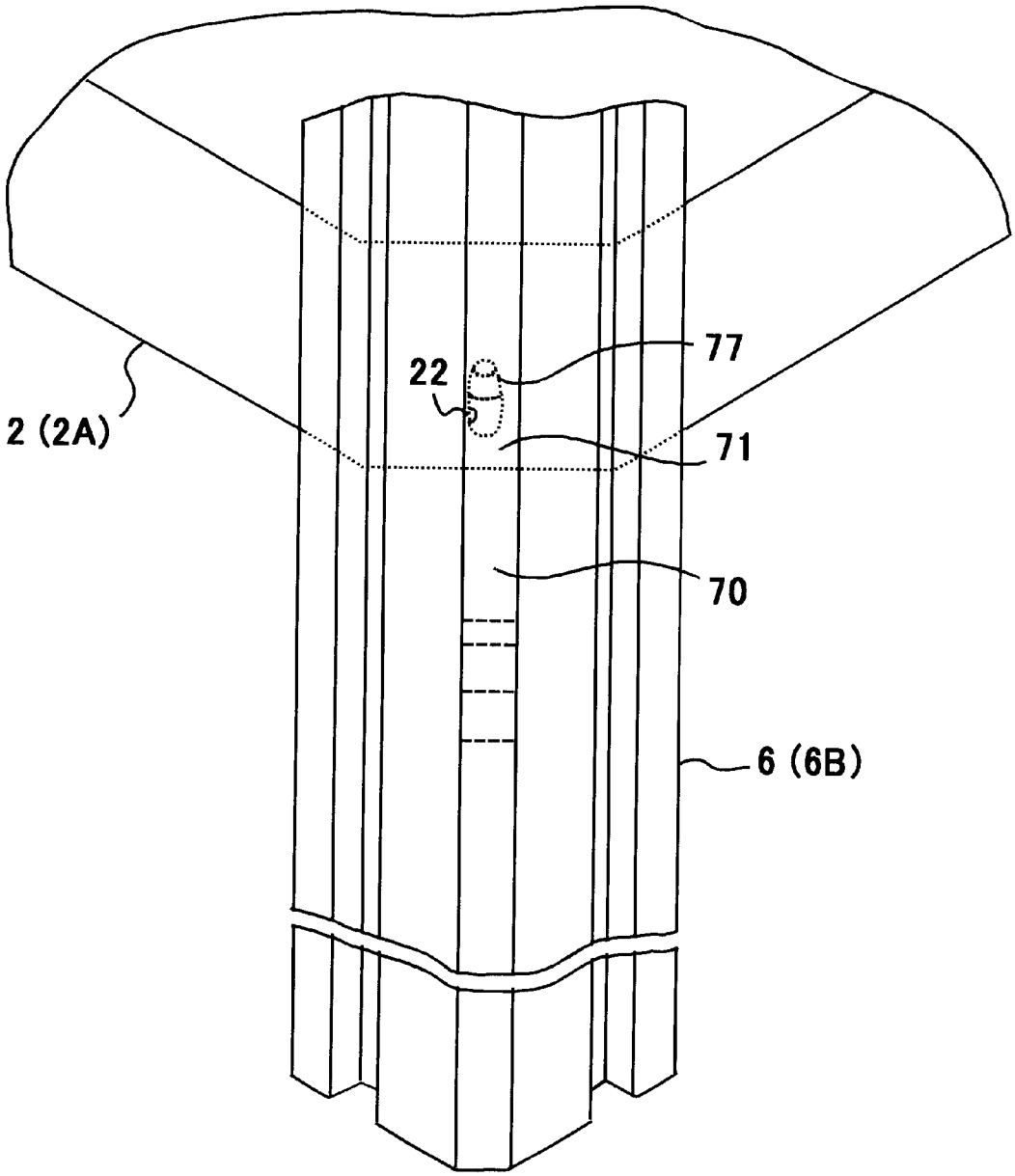
FIGS. 8 to 10 are perspective views illustrating how the article carrier is supported by the post through the carrier receiving member.
Figure 9:
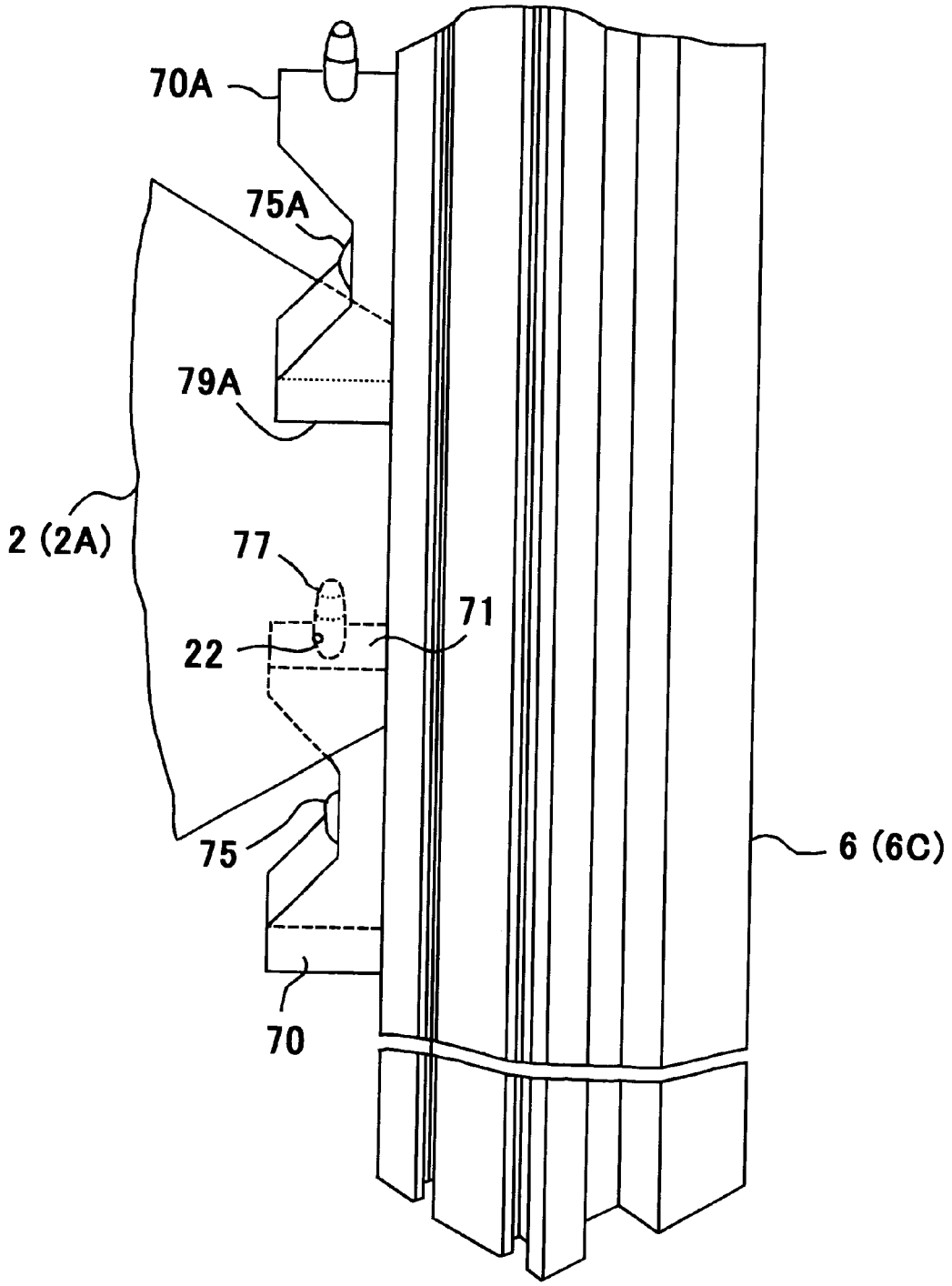
Figure 10:
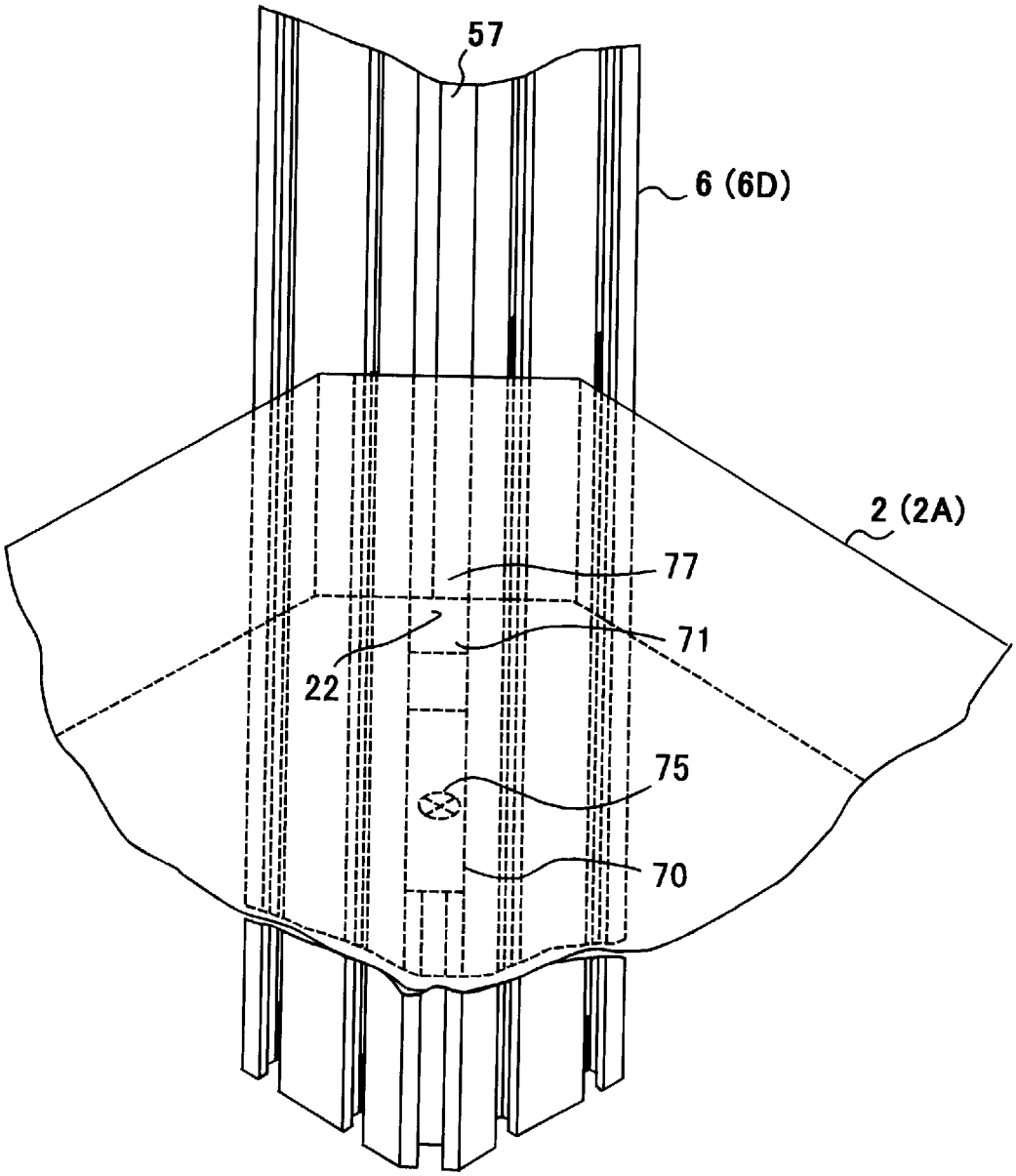

FIGS. 8 to 10 are enlarged perspective views of the second to fourth posts 6B, 6C, 6D, respectively, when seen in the same direction as FIG. 3. As illustrated in these figures, the carrier receiving member 70 configured completely in the same manner as the carrier receiving member illustrated in FIG. 7 is also attached removably to the second to fourth posts 6B, 6C, 6D completely in a similar manner to the foregoing. In this event, the four carrier receiving members 70 are attached to the respective posts 6 such that the upper surfaces 71 thereof are substantially at the same level.

Next, the respective corners of a selected article carrier 2A are placed on the upper surfaces 71 of the respective carrier receiving members 70, as illustrated in FIGS. 6, 8, 9 and 10. In this way, the article carrier 2A is supported from below by the four carrier receiving members 70, and disposed in the space defined inside the plurality of posts 6. In this event, a positioning pin 77 protrusively formed on the upper surface 71 of each carrier receiving member 70 is fitted into a positioning hole 22 formed in the lower surface of the article carrier 2A. In this way, the article carrier 2 is positioned correctly with respect to the respective posts 6 in the horizontal direction.

The positioning pins 77 and the positioning holes 22 as illustrated constitute exemplary positioning means for positioning the carrier receiving members 70 with respect to the article carrier 2A supported by the carrier receiving members 70 and for positioning the article carrier 2A with respect to the posts 6. Alternatively, the carrier receiving members 70 may be formed with positioning holes, and the article carrier 2 be protrusively formed with positioning pins for insertion into the positioning holes, such that the positioning means are constituted by these holes and pins.

On the other hand, the carrier pressing member 70A illustrated in FIG. 6 is configured completely in the same manner as the aforementioned carrier receiving member 70, and attached to the post 6A in a manner similar to the carrier receiving member 70. Specifically, the carrier pressing member 70A is removably fixed to the post 6A by a nut (not shown) fitted in the groove 57 and a screw 75A with its lower surface 79A abutting to the upper surface of the article carrier 2A supported by the carrier receiving members 70. While the carrier pressing member 70A is removably fixed to the remaining posts 6B, 6C, 6D completely in a similar manner, FIGS. 8 and 10 illustrate that the carrier pressing members 70A have not been attached to the respective posts 6B, 6D. The carrier receiving members 70 and the carrier pressing members 70A are made, for example, of metal, resin, wood, rubber or the like.

By fixing the carrier pressing members 70A to the respective posts 6 as described above, the article carrier 2A has its upper surface pressed by the carrier pressing members 70A. Consequently, the article carrier 2A is held by the carrier pressing members 70A and the carrier receiving members 70 from above and below and therefore is supported by the posts 6 without coming off from the posts 6.

After the article carrier 2A is attached to the respective posts 6, an article carrier 2B positioned above the article carrier 2A is attached to the respective posts 6 through the carrier holding means just as is the case of the article carrier 2A, as illustrated in FIGS. 1 and 2. For attaching three or more article carriers, they may be attached to the respective posts 6, for example, sequentially from the lowermost article carrier.

Then, as illustrated in FIG. 1, articles 1 are placed on the respective article carriers 2A, 2B attached to the posts 6 as described above. In this event, the articles 1 may be placed on the respective article carriers 2 after they are attached to the posts 6. Alternatively, the lowermost article carrier 2A may be first attached to the posts 6 to place the articles 1 thereon, and then, the upper article carrier 2B may be attached to the posts 6 to place the remaining articles 1 thereon.

Also, while the respective article carriers 2A, 2B may be attached to the posts 6 after the spacings between the posts 6 have been adjusted as described above in accordance with the size of the article carriers 2, the positioning pins 77 of the respective carrier receiving members 70 may be fitted into the respective positioning holes 22 at the respective comers of the article carrier 2A, while moving the respective posts 6, when the article carrier 2A is placed on the upper surfaces 71 of the respective carrier receiving members 70 after they have been fixed to the respective posts 6, in which case the spacing between the respective posts can be automatically adjusted to dimensions suitable for the lengths of the respective sides of the article carrier 2A.

The articles 1 carried on the article carriers 2A, 2B may be positioned with respect to the article carriers 2A, 2B, as required, by article positioning means, for example, comprised of pins, not shown, protrusively formed on the articles 1 and holes, also not shown, formed in the article carriers 2A, 2B for fitting the pins on the articles 1 thereinto. Alternatively, the articles 1 may be fixed on the article carriers 2A, 2B by article fixing means, for example, comprised of bolts and nuts in such a manner that the articles 1 are readily removable therefrom.

The article transporting/storing apparatus has been assembled as described above, and the articles are accommodated in the accommodating space surrounded by the four posts 4, as carried on the article carriers 2A, 2B. In this state, forks of a material handling truck such as a forklift truck, for example, are inserted below the lowermost article carrier 2A, and elevated to lift the article transporting/storing apparatus for transportation. Also, the article transporting/storing apparatus with the articles 1 carried thereon may be transferred to a truck, a ship, or a railway vehicle for transportation. Further, the articles 1 accommodated in the article transporting/storing apparatus may be stored in a warehouse or the like. In this event, the articles 1 can be protected by the first and second coupling members 14, 15.

For example, from a manufacturing factory of printers, which are an example of articles to be transported, the article transporting/storing apparatus with the articles 1 carried thereon is transported to the user. Then, after the articles 1 are taken off the article carrier 2, the empty article transporting/storing apparatus is again returned to the manufacturing factory. In this way, the articles can be again loaded on the article transporting/storing apparatus for transportation. This operation can be applied as well to the transportation of articles such as products, parts thereof, etc. between factories, and the transportation of parts from a part manufacturer to an assembling factory.

In this way, the article transporting/storing apparatus can be used any number of times. Conventional corrugated boxes for accommodating articles for purposes of transportation are often wasted at their destination, resulting in a large amount of wastes. In contrast, with the article transporting/storing apparatus of this embodiment, wastes can be eliminated, or the amount of wastes can be significantly reduced.

Also, as illustrated in FIGS. 1 to 3, each post 6 is provided with a caster 80 attached to the lower end, which facilitate movements of the article transporting/storing apparatus on the floor and the ground. Each caster 80 is attached to the associated post 6 by fitting a post shaft (not shown) formed on the top thereof into the lower end of the center hole 62 (FIG. 4) of the post 6.

As described above, a variety of sizes of article carriers 2 may be provided such that a variety of articles different in number, size and form are efficiently transported or stored by the article transporting/storing apparatus.

Also, in the article transporting/storing apparatus of this embodiment, the article carrier 2 is supported by the posts 6 through the carrier holding means as described above. The carrier holding means are removably fixed to the posts 6 and have the carrier receiving members 70 for supporting the article carrier 2 from below, so that the article carrier 2 can be supported by the posts 6 in a stable state. While the article carrier 2 may be supported by the posts 6 only through the carrier receiving members 70, the carrier holding means of this embodiment additionally has the carrier pressing member 70A which is removably fixed to the posts 6 for pressing the upper surface of the article carrier 2, thereby making it possible to more reliably hold the article carrier 2 by the posts 6.

Since the carrier receiving member 70 and the carrier pressing member 70A are fitted in the groove 57 formed in the longitudinal direction of each post 6 for movements therealong, the carrier receiving member 70 and the carrier pressing member 70A may be moved along the post 6 by loosening the screws 75, 75A and set at an arbitrary level in the longitudinal direction of the post. Then, the carrier receiving member 70 and the carrier pressing member 70A can be fixed to the post 6 at the set level, so that the article carrier 2 can be held at this level. In this way, the carrier holding means is configured such that the article carrier 2 can be held at a different level in the longitudinal direction of the posts 6. Moreover, a plurality of article carriers 2 can be attached to the posts 6 by increasing the number of carrier holding means, and the number of article carriers 2 can be selected as appropriate in accordance with the height and number of the articles 1.

Figure 11:
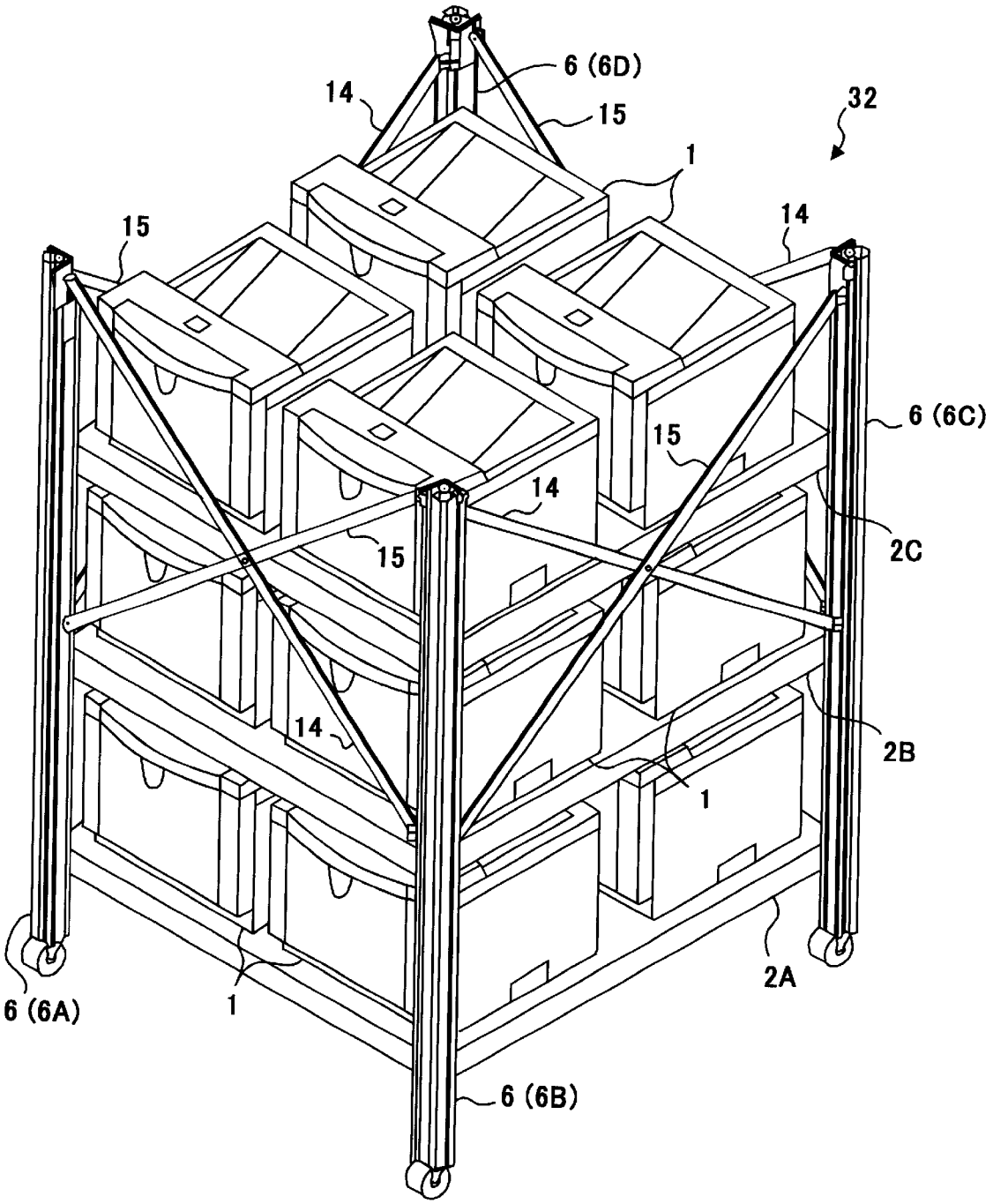
FIG. 11 is a perspective view of the article transporting/storing apparatus which has three article carriers attached to the posts.

FIG. 11 illustrates the article transporting/storing apparatus provided with three stages of vertically arranged article carriers 2A, 2B, 2C which are removably fixed to the respective posts 6 as described above, and each of which carries articles 1 which are printers having a height smaller than the printers previously illustrated in FIG. 1.

The vertical dimensions of the spaces for accommodating the articles 1 can be adjusted by properly selecting the number of article carriers 2, so that when finished industrial products, semi-finished products or parts thereof are to be transported as the articles 1, a number of article carriers 2 in accordance with the form, size and number of the respective articles may be used to efficiently transport or store the respective articles.

Figure 12:
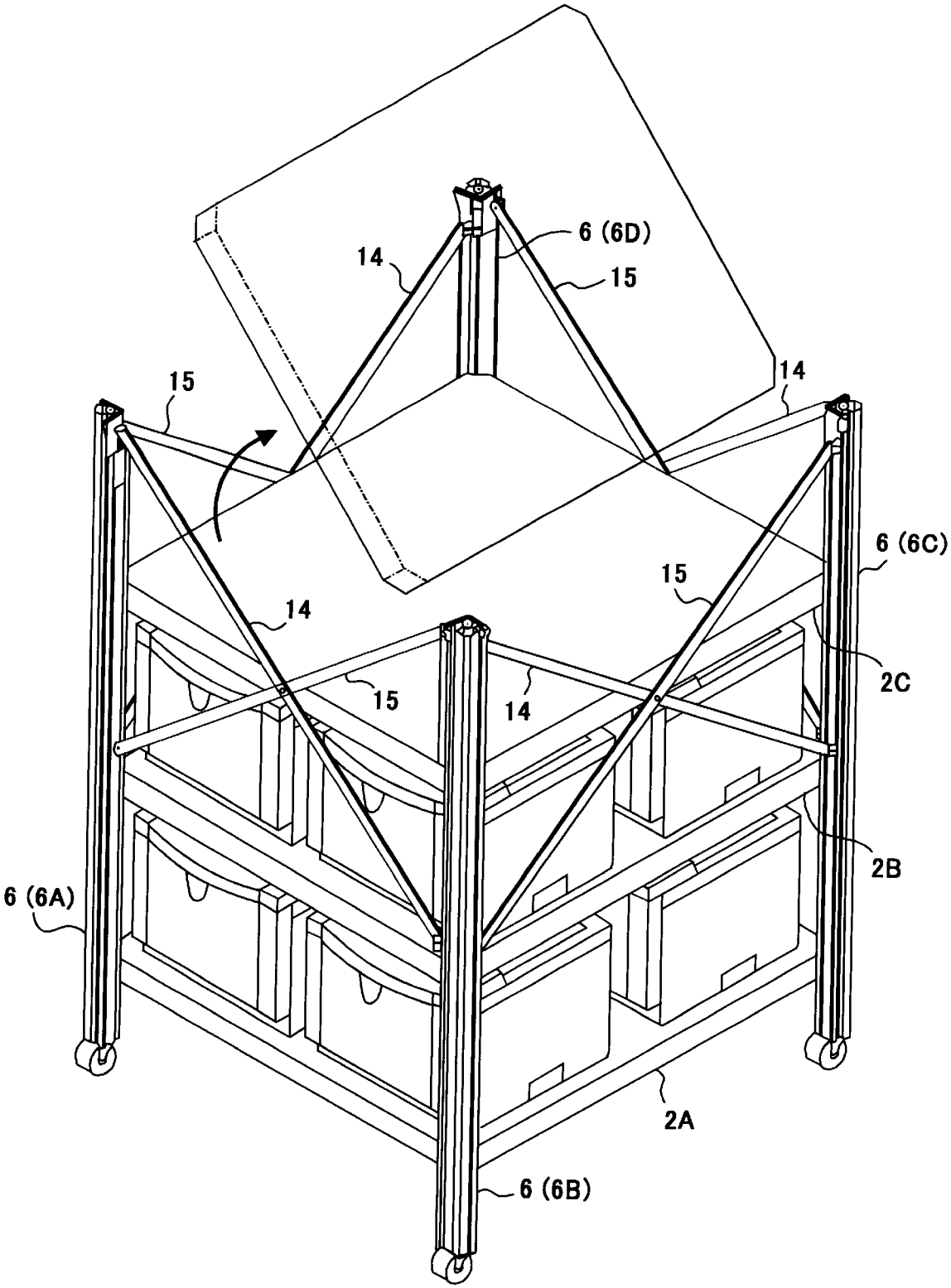
FIG. 12 is a perspective view of an article transporting/storing apparatus which uses a topmost article carrier as a roof.

Further, when a plurality of article carriers 2 are fixed to the posts 6, the topmost article carrier may be used as a roof. FIG. 12 illustrates the article transporting/storing apparatus which has article carriers 2A, 2B, 2C fixed to the respective posts 6 at three stages in the vertical direction, with the topmost article carrier 2C used as a roof. In this way, the respective articles 1 accommodated in the article transporting/storing apparatus can be covered with the overlying article carriers 2B, 2C to improve a function of protecting the articles during transportation or storage of the articles 1.

By loosening the screws 75, 75A illustrated in FIG. 6, each article carrier 2 can be readily removed from the posts 6 as indicated by chain lines in FIG. 12, while the carrier receiving members 70 and the carrier pressing members 70A are removed from the respective posts 6. The article carriers 2 are removably attached to the posts 6. With such a structure, the article carriers 2 may be removed from the posts 6 when the article transporting/storing apparatus is not in use, and put one above the other for storage.

Figure 13:
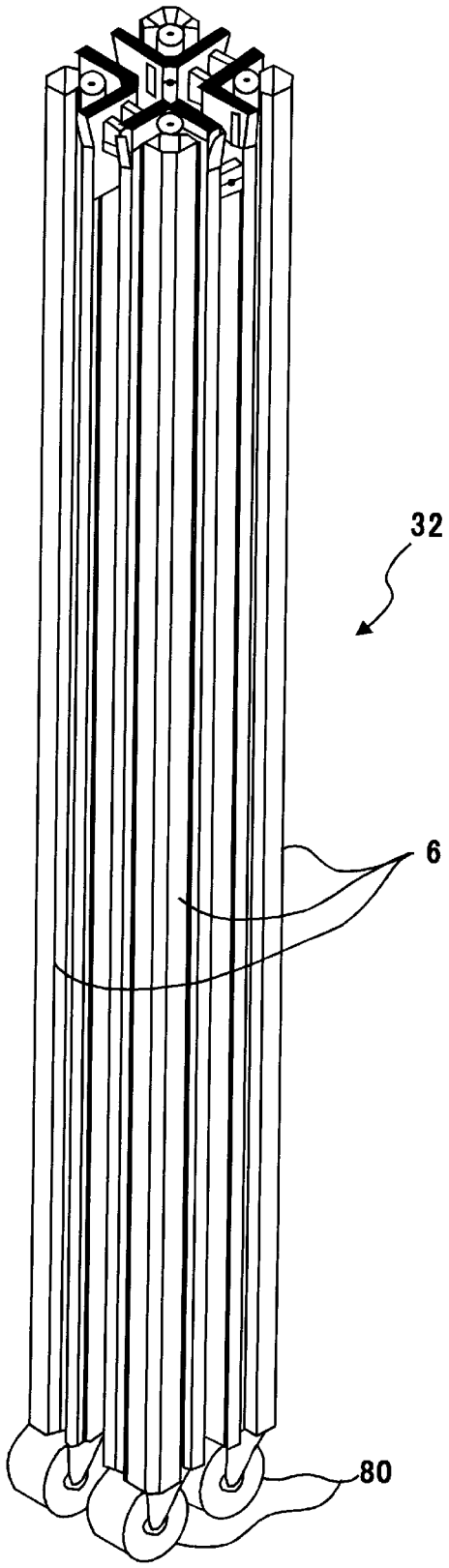
FIG. 13 is a perspective view of the article transporting/storing apparatus when a post unit is folded up.

When the four posts 6 are grabbed by hands and pressed in a direction in which they approach to one another after the carrier receiving members 70, the carrier pressing members 70A and the article carriers 2 have been removed from the posts 6, the second joints 109, 209 illustrated in FIG. 4 are slid downward along the posts 6, and the first and second coupling members 14, 15 disposed between the respective posts are pivoted about the pins 21 and folded up. Consequently, the entire article transporting/storing apparatus can be folded up in a compact configuration as illustrated in FIG. 13.

Thus, the posts 6 and the post coupling means for coupling the posts 6 constitute a foldable post unit 32. For example, the post unit 32 may be folded up as described above after articles 1 have been taken off from the article carriers 2 at a destination such as a user to efficiently transport the article transporting/storing apparatus back to the originating site such as a manufacturing factory.

Figure 14:
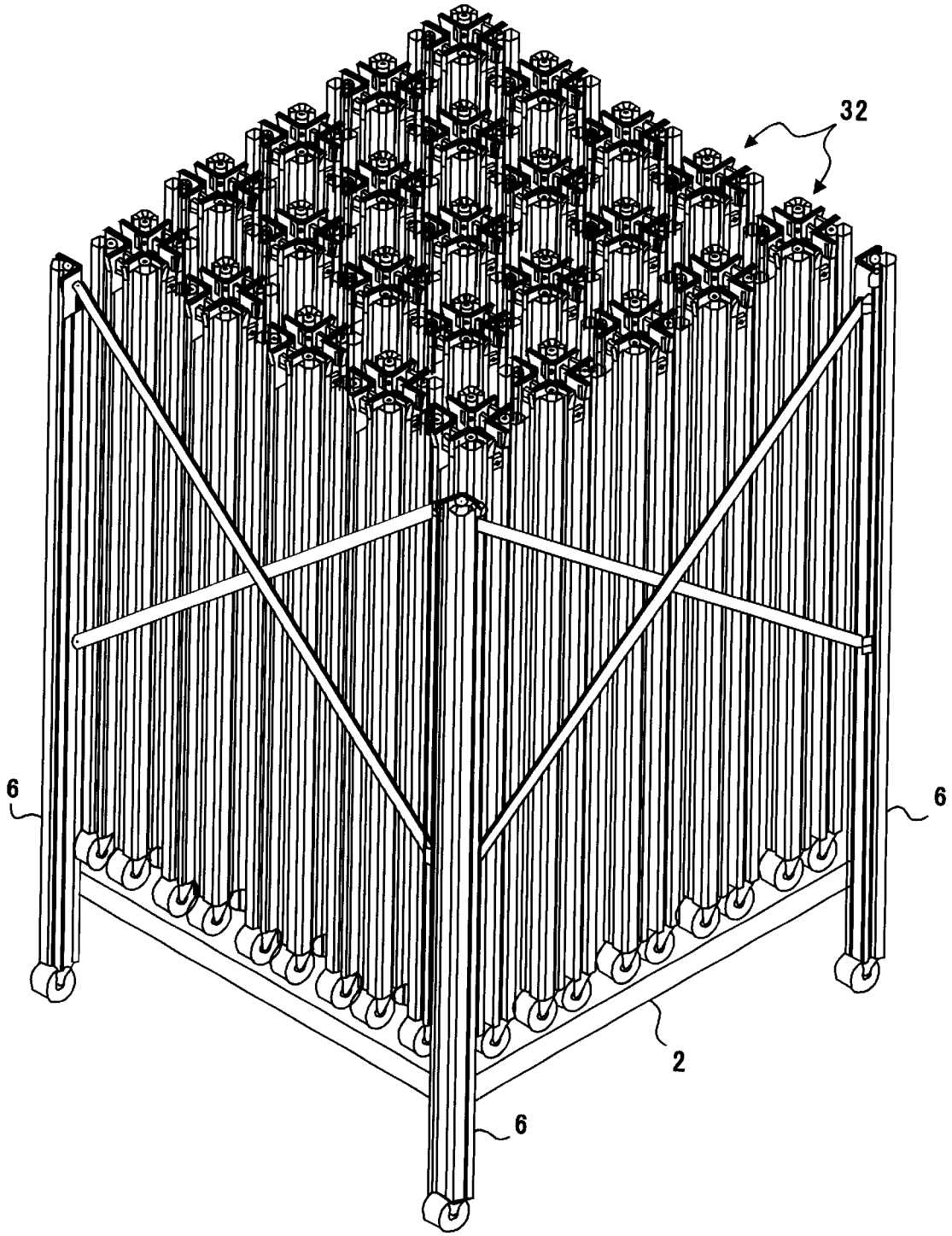
FIG. 14 is a perspective view illustrating how a number of post units are carried on an article carrier.

Specifically, a large number of article transporting/storing apparatus, each of which carries the articles 1, are collectively transported to a destination where the articles 1 are taken off from the article transporting/storing apparatus, and the empty article transporting/storing apparatus are returned back to the originating site. In this event, as illustrated in FIG. 14, one article carrier 2 is fixed to lower end portions of four posts 6 of one article transporting/storing apparatus. The article carriers 2 are removed from the post units 32 of the remaining article transporting/storing apparatus, and the post units 32 are folded up as illustrated in FIG. 13. Then, a large number of the folded post units 32 can be accommodated on the article carrier 2 illustrated in FIG. 14 in an upright posture, and collectively returned back to the originating site.

Figure 15:
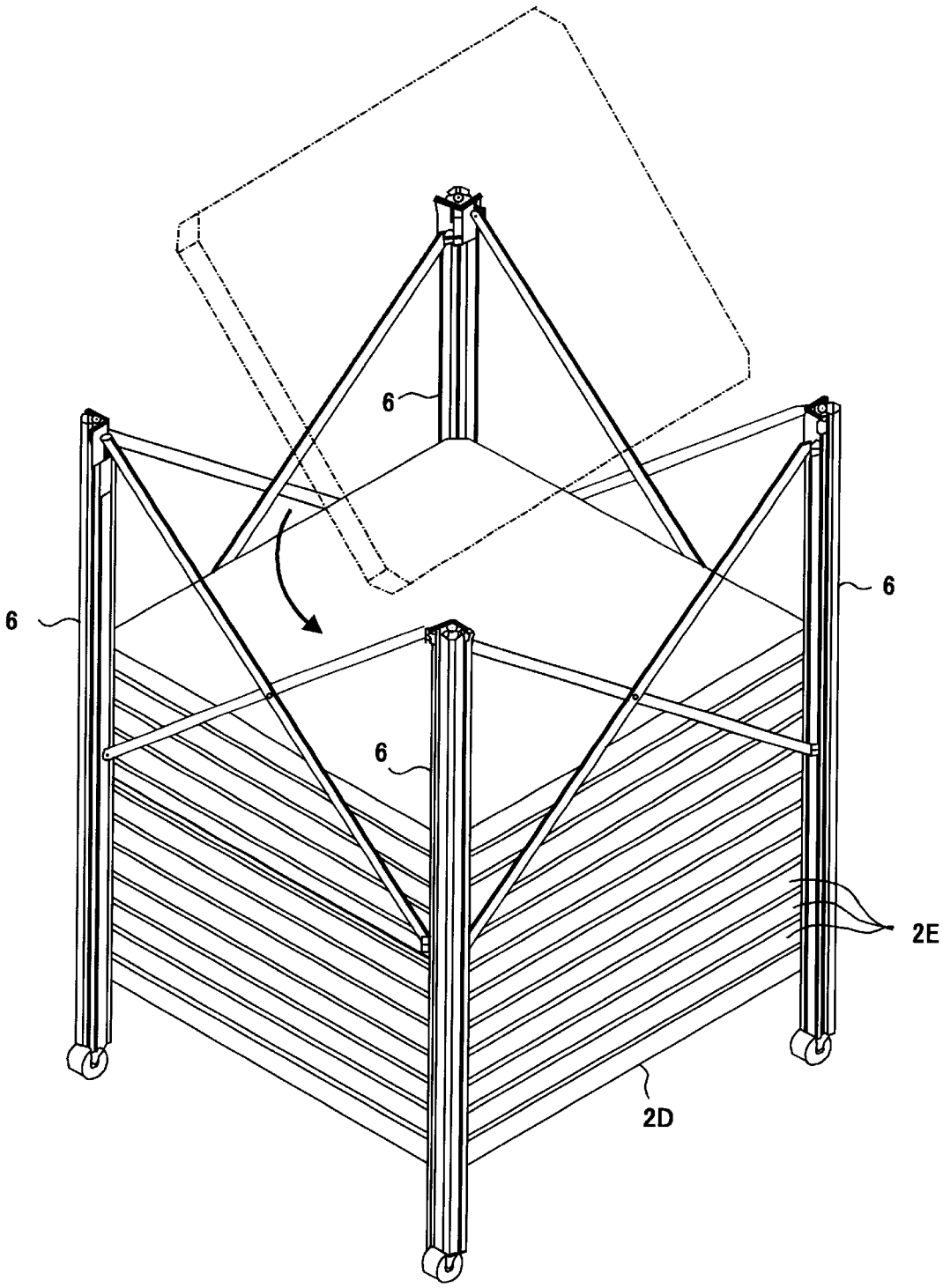
FIG. 15 is a perspective view illustrating how a number of article carriers are supported by a single lowermost article carrier.

Moreover, one article carrier 2D may be fixed to lower end portions of four posts 6 of another article transporting/storing apparatus as illustrated in FIG. 15 for placing a large number of article carriers 2E, removed from the post units 32 of the remaining article transporting/storing apparatus, one above the other. In this way, the article carriers 2E can be collectively returned back to the originating site. In addition, the article transporting/storing apparatus may be stored in the states illustrated in FIGS. 14 and 15. In the manner described above, a large number of article transporting/storing apparatus can be collectively returned to the originating site in a compact configuration, and stored in a small space.

As illustrated in FIG. 4, the illustrated article transporting/storing apparatus is formed with a grip 68 on each post 6 extending in the longitudinal direction of the post 6. Each grip 68 is disposed at a position facing the outside when the post unit 32 is folded up as illustrated in FIG. 13. Each post 6 is formed with two grooves 69 extending over the entire length thereof in the longitudinal direction, and a portion between the grooves 69 is formed as the grip 68.

For adjusting the spacing between the posts 6, attaching or removing an article carrier to or from the posts 6, or folding up the post unit 32 as illustrated in FIG. 13, the operator generally works with the posts grabbed by his hands. In this event, the work can be facilitated if the operator grabs the grips 68. Particularly, for bringing the posts 6 close to each other to fold up the post unit 32 as illustrated in FIG. 13, if the operator clutches the whole post 6 or grabs the coupling members 14, 15 for working, the operator is likely to have his finger caught between the posts 6 or between the coupling members 14, 15. Such a trouble can be avoided if the operator folds up the post unit 32 with the grips 68 grabbed by his hands.

In the article transporting/storing apparatus previously described in connection with FIGS. 4 and 5, the two first joints 108, 208 attached to each post 6 are fixed to the post 6, and the two second joints 109, 209 attached to each post 6 are slidably fitted in the guide grooves 54, 55 formed in the post.

Alternatively, as opposed to the foregoing structure, the first joints 108, 208 positioned on the upper side of each post 6 may be slidably fitted in guide grooves formed in the post 6 in the longitudinal direction, while the second joints 109, 209 on the lower side may be securely fixed to the post 6, in which case, the first movable joints 108, 208 are slid in the longitudinal direction of the post 6 when a pair of adjacent posts are brought closer to or further away from each other, so that the spacing between the two posts can be adjusted by pivoting the first and second coupling members 14, 15 between the two posts about the intermediate pin 21. In essence, either the first joints or the second joints may be fixed to the post 6, with the other joints being slidably fitted in the guide grooves formed in the post 6 in the longitudinal direction.

The joints longitudinally slidably assembled into each post 6, i.e., the two second joints 109, 209 in the embodiment illustrated in FIG. 4, are fitted in the guide grooves 54, 55 formed in the post 6, and configured to slide as guided by the guide grooves 54, 55. Particularly, in the embodiment illustrated in FIG. 4, the first joints 108, 208 are also fitted in the guide grooves 54, 55 formed in the post 6, so that these joints may be comprised of small parts made of metal, resin or the like, by way of example.

For this reason, when the post unit 32 is folded up as illustrated in FIG. 13, the respective joints can be concealed between the posts 6, thereby preventing the joints from largely protruding outside the post unit 32. This facilitates the transportation of the folded post unit 32. Moreover, when a plurality of post units 32 are arrayed as illustrated in FIG. 14, a space required by these post units 32 can be reduced.

The post coupling means of the article transporting/storing apparatus has the first and second coupling members 14, 15 disposed between each pair of adjacent posts 6, and the first and second joints for coupling the respective coupling members 14, 15 to the associated posts 6, with two first joints 108, 208 and two second joints 109, 209 disposed between the respective posts 6. With this structure, all the spacings between the two adjacent posts can be adjusted. As an alternative to this structure, the post coupling means may be configured to allow adjustments of only the spacing between two adjacent posts and the spacing between two adjacent posts which oppose the former two posts.

Figure 16:
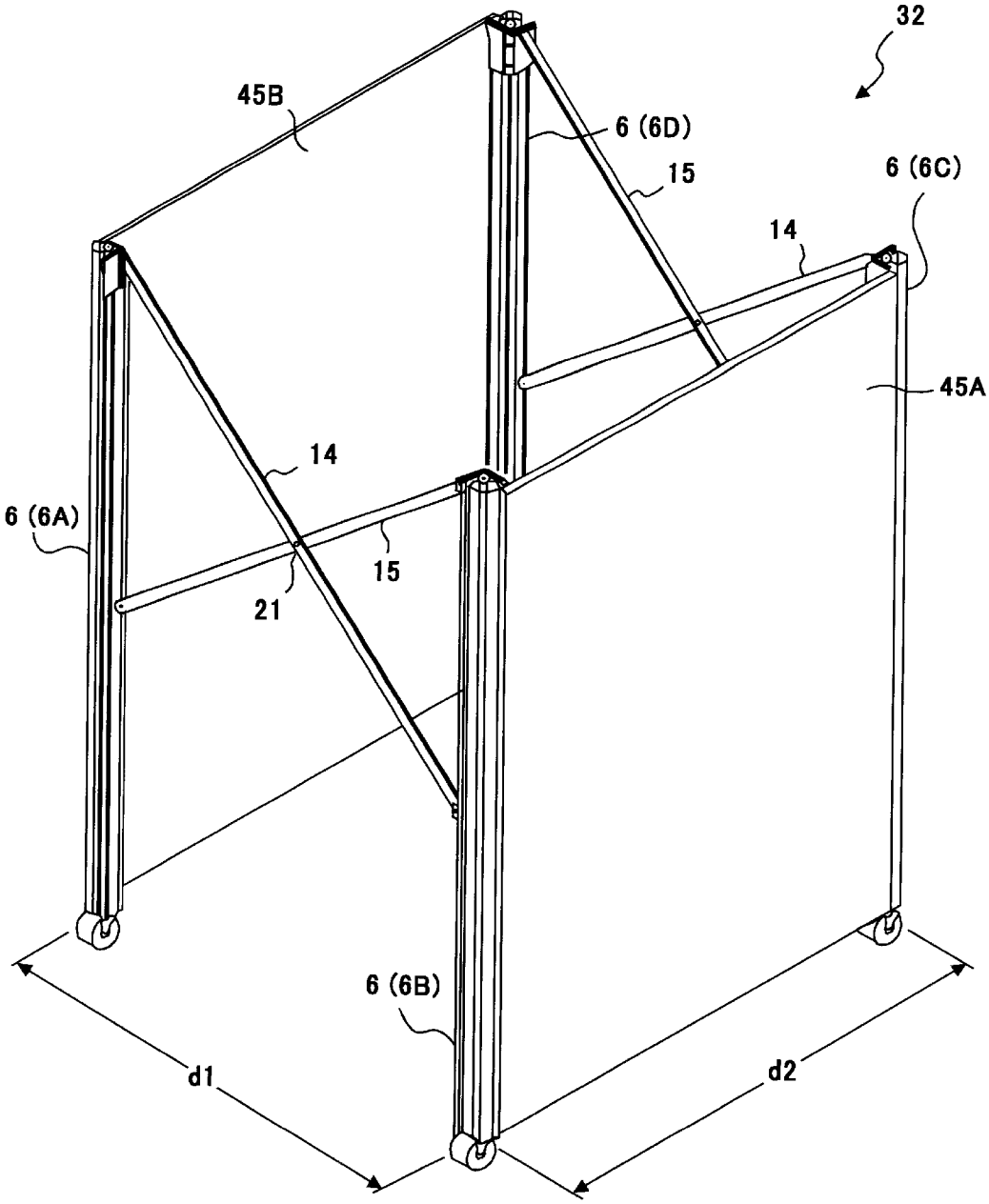
FIG. 16 is a perspective view of a post unit which has a pair of posts and another pair of posts opposite thereto fixed by panels, respectively.

For example, the first and second coupling members 14, 15 disposed between the second and third posts 6B, 6C and the first and second coupling members 14, 15 disposed between the first and fourth posts 6A, 6D, illustrated in FIG. 3, are omitted, and instead, the second and third posts 6B, 6C are firmly fixed through a secure coupling member 45A, and the first and fourth posts 6A, 6D are firmly fixed through another secure coupling member 45B, as illustrated in FIG. 16.

With this structure, while the spacing d2 between the second post 6B and the third post 6C and the spacing d2 between the first post 6A and the fourth post 6D cannot be adjusted, the spacing d1 between the first post 6A and the second post 6B and the spacing d1 between the third post 6C and the fourth post 6D can be adjusted, so that article carriers 2 of a desired size can be attached to the respective posts 6 by adjusting the spacings d1 between the first and second posts 6A, 6B and between the third and fourth posts 6C, 6D corresponding to the particular article carriers 2.

In this way, the article transporting/storing apparatus can be adjusted in size in accordance with the size, form or number of particular articles to efficiently transport or store the articles. The same is true when the first and second posts 6A, 6B are securely coupled and the third and fourth posts 6C, 6D are securely coupled.

In the embodiment illustrated in FIG. 16, one first joint and one second joint, to which each end of the first and second coupling members 14, 15 disposed between the first and second posts 6A, 6B and between the third and fourth posts 4C, 4D is pivotally attached, are attached to each post 6. The post unit 32 can be folded up by approaching the second and third posts 6B, 6C securely coupled to each other to the first and fourth posts 6A, 6D, likewise securely coupled to each other.

The post coupling means in the respective embodiments described above is configured to couple two adjacent posts to each other such that at least two spacings, i.e., the spacing between the two adjacent posts and the spacing between the remaining two adjacent posts opposite to the former posts can be adjusted. As an alternative to this structure, the post coupling means may be configured in the following manner.

FIGS. 17 to 22 are schematic plan views of some post units viewed from above. In an embodiment illustrated in FIG. 17, the post unit has first to third posts 6A, 6B, 6C, post coupling means for these posts have first and second coupling members 14, 15 disposed between the first and second posts 6A, 6B and crossing each other; a secure coupling member 45C for securely coupling the second and third posts 6B, 6C with each other; a secure coupling member 45D for securely coupling the third and first posts 6C, 6A with each other; and first and second joints (not shown in FIG. 17) to which respective ends of the first and second coupling members 14, 15 are pivotably coupled. The joints are configured in the same manner as the first and second joints 108, 109 illustrated in FIG. 4. The first and second coupling members 14, 15 are also identical to the coupling members in the foregoing embodiments. The secure coupling member 45C is pivotably coupled to the second and third posts 6B, 6C, and the other secure coupling member 45D is also pivotably coupled to the third and first posts 6C, 6A.

Figure 17:
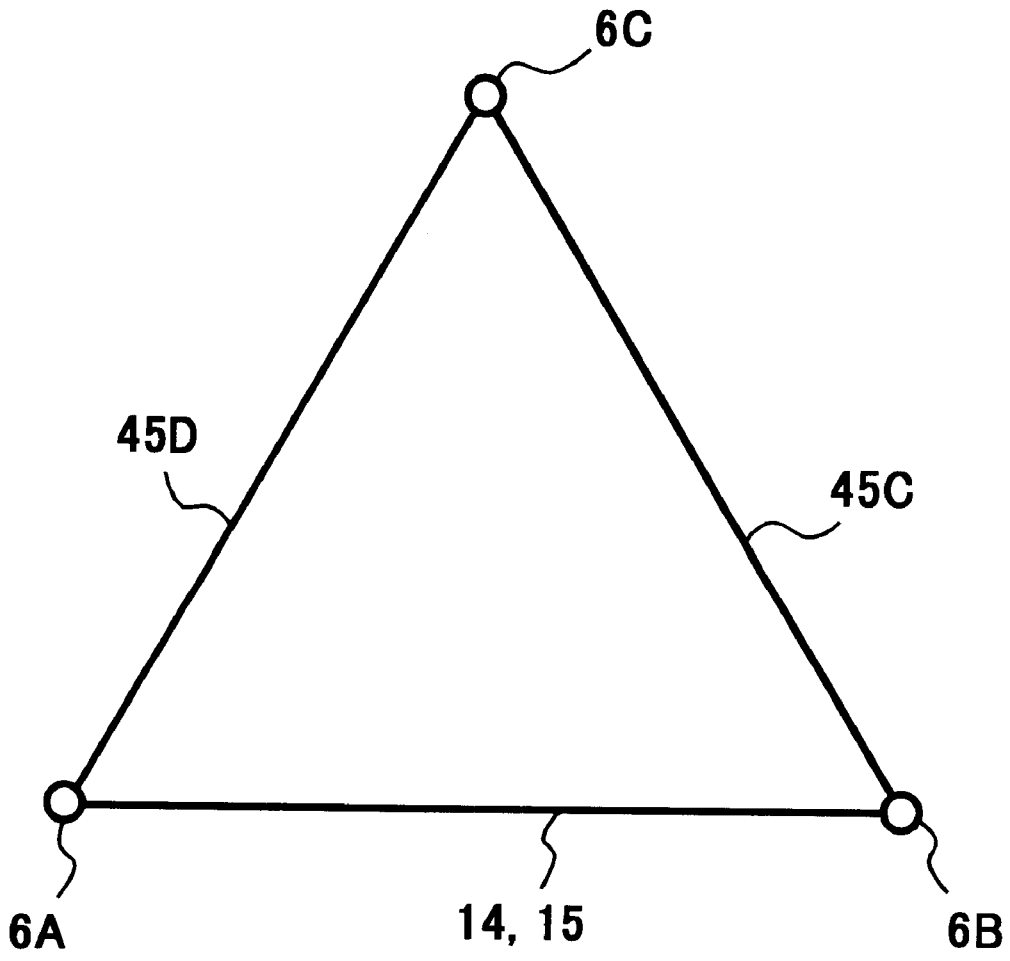
FIG. 17 is a schematic plan view of a post unit having three posts.
Figure 18:
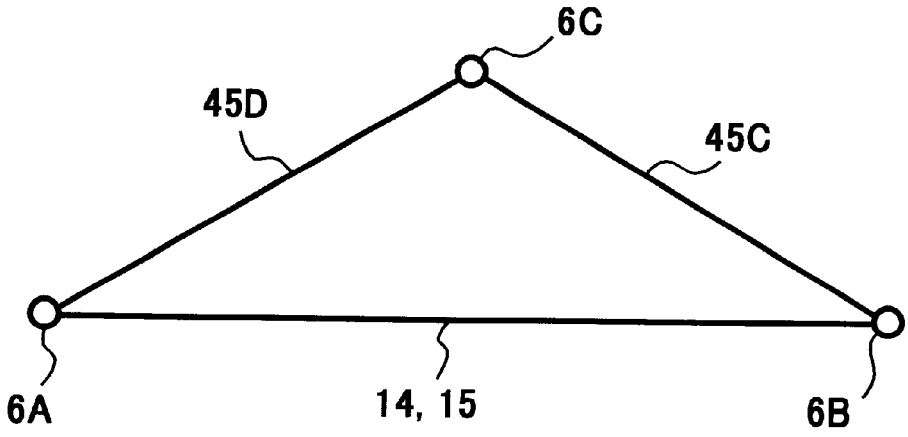
FIG. 18 is a schematic plan view of the post unit illustrated in FIG. 17 when a spacing between posts is extended.

As described above, only the spacing between the first and second posts 6A, 6B is adjustable in the embodiment illustrated in FIG. 17. Specifically, as the first and second posts 6A, 6B are pressed in opposite directions so that they are spaced further away, the spacing between the two posts 6A, 6B becomes wider by the action of the first and second coupling members 14, 15 disposed between these posts 6A, 6B and the first and second joints attached to the respective posts 6A, 6B. Associated with this action, the two secure coupling members 45C, 45D are relatively pivoted with respect to the respective posts, resulting in the plane form of the post unit transformed as illustrated in FIG. 18. The spacing between the posts is changed in this way in accordance with the form of a particular article carrier.

Figure 19:
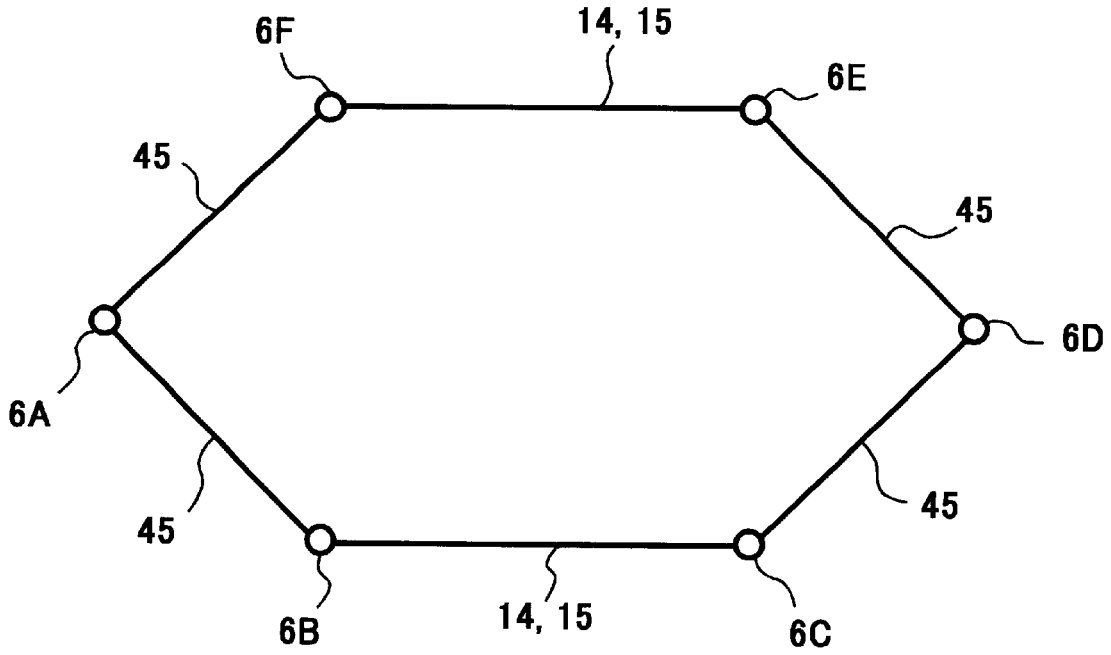
FIG. 19 is a schematic plan view of a post unit having six posts.
Figure 20:
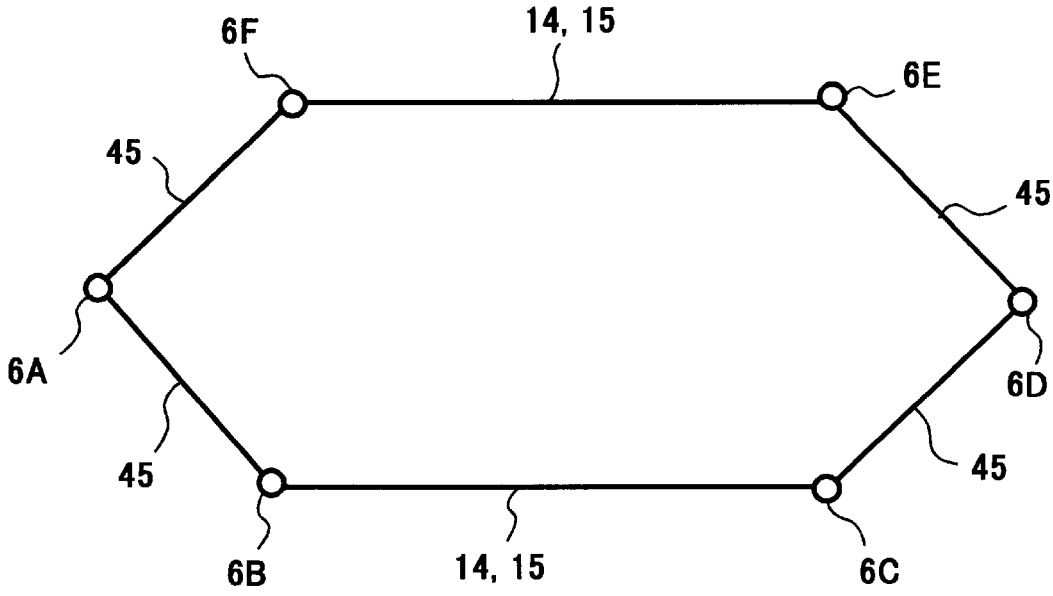
FIG. 20 is a schematic plan view of the post unit illustrated in FIG. 19 when spacings between posts are extended.

In an embodiment illustrated in FIG. 19, an article transporting/storing apparatus comprises six posts 6A–6F, wherein mutually cross-coupled coupling members 14, 15 are provided between the posts 6B, 6C and between posts 6E, 6F opposing the pots 6B, 6C. The spacings between these posts can be adjusted by the action of these coupling members 14, 15 and the aforementioned first and second joints. On the other hand, secure coupling members 45 are provided between pairs of posts 6F and 6A; 6A and 6B; 6C and 6D; and 6D and 6E, respectively. FIG. 20 illustrates a plan view of the article transporting/storing apparatus when the spacing between the posts 6B, 6C and the spacing between the posts 6E, 6F are extended.

Figure 21:
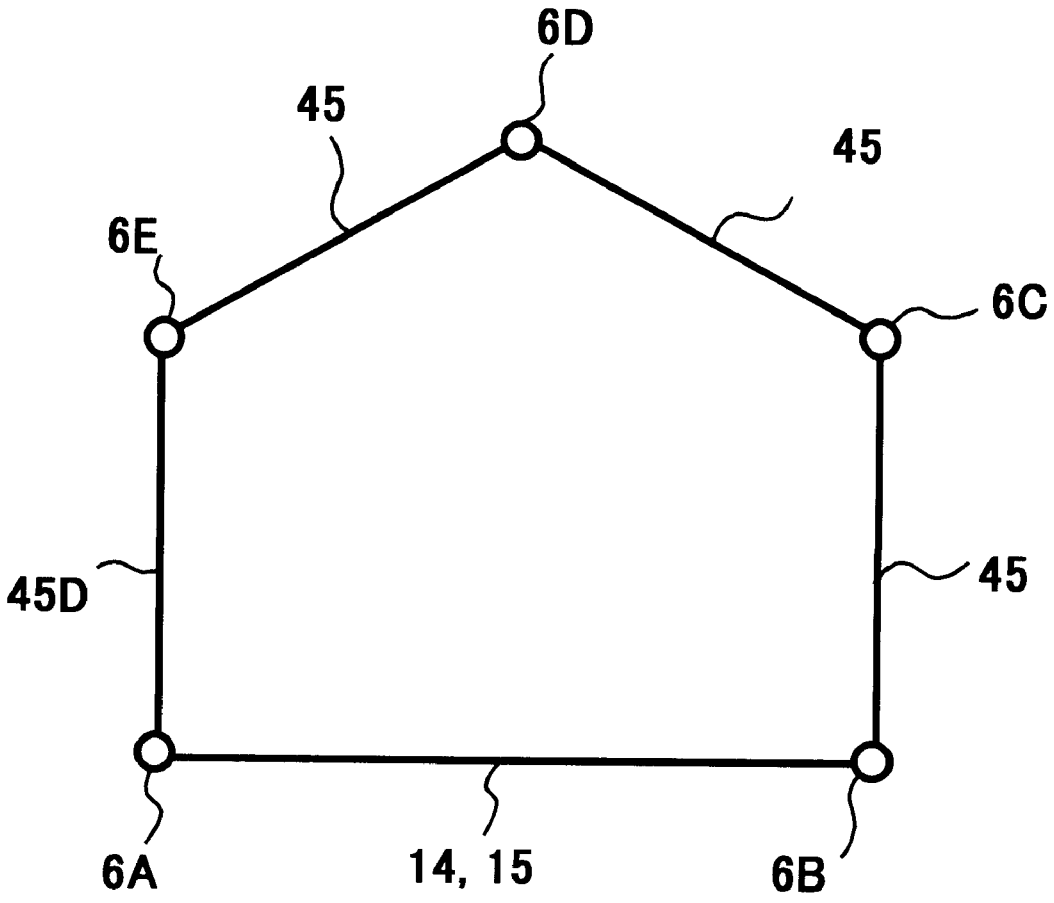
FIG. 21 is a schematic plan view of a post unit having five posts.
Figure 22:
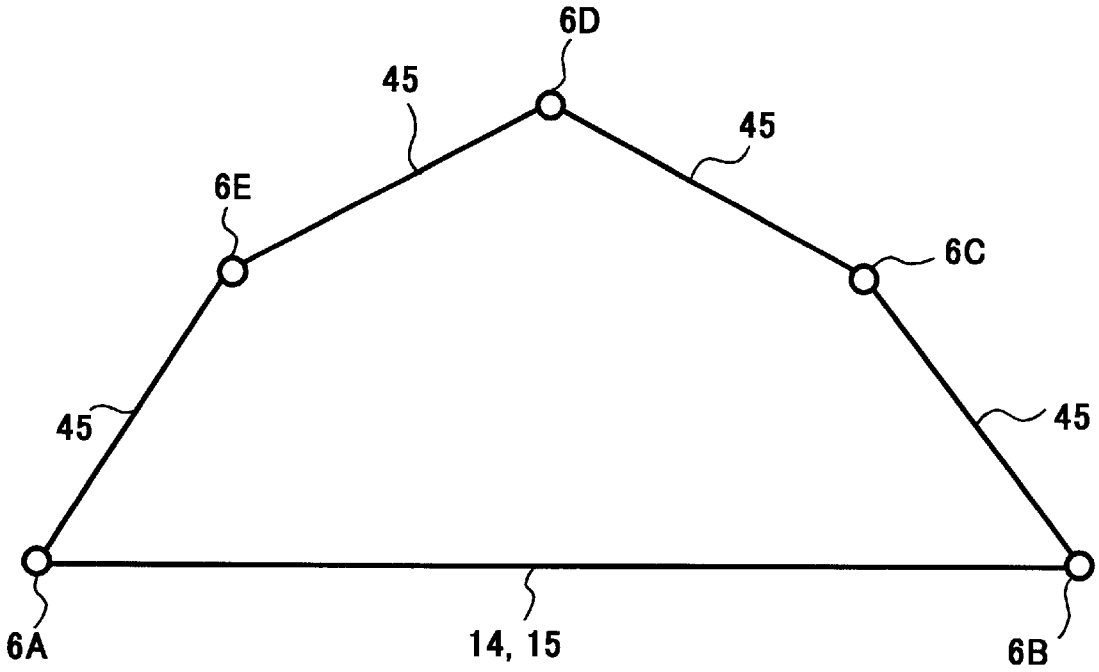
FIG. 22 is a schematic plan view of the post unit illustrated in FIG. 21 when spacings between posts are extended.

FIG. 21 illustrates an embodiment of the article transporting/storing apparatus which has five posts 6A–6E, wherein coupling members 14, 15 are provided between the two pots 6A, 6B, and respective two adjacent ones of the remaining posts are securely coupled by a secure coupling member 45. FIG. 22 illustrates a plan view of the article transporting/storing apparatus when the spacing between the posts 6A, 6B is extended.

As can be seen from the respective embodiments described above, the number of posts 6 and their arrangements can be selected as appropriate to determine how the coupling members 14, 15 are arranged in accordance with a desired form of the post unit. The post coupling means couple adjacent posts to each other to enable an adjustment of at least one spacing between the posts.

The post coupling means in any embodiment has first and second coupling members disposed between two posts, the spacing of which can be adjusted, and crossing each other; first joints pivotably coupled to respective longitudinal ends on the upper sides of the first and second coupling members and attached to the two posts, the spacing of which can be adjusted, respectively; and second joints pivotably coupled to respective longitudinal ends on the lower sides of the first and second coupling members and attached to the two posts, the spacing of which can be adjusted, respectively, wherein either the first joints or the second joints are fixed to the respective posts to which they are attached respectively, and the others are slidably fitted in the guide grooves formed in the longitudinal direction in the respective posts to which they are attached respectively.

When at lest one of the spacings between the posts is made unadjustable, the post coupling means has a secure coupling member for coupling the two adjacent posts, the spacing of which cannot be adjusted. Alternatively, as illustrated in FIG. 16, when two adjacent posts are securely coupled and two posts opposing them are securely coupled, the post coupling means has the secure coupling member 45A for securely coupling the two adjacent posts 6B, 6C, the spacing of which cannot be adjusted, and the secure coupling member 45B for securely coupling the two adjacent posts 6A, 6D, the spacing of which cannot be adjusted. In this event, while the secure coupling members could be comprised of rod-like members, the secure coupling members 45A, 45B may be comprised of panels of large area as illustrated in FIG. 16 to more reliably protect articles carried on the article carriers 2 by the panels.

Further, for example, when all the spacings between all the pairs of adjacent posts can be adjusted with the first and second coupling members 14, 15 disposed between all the pairs of adjacent posts, the two first joints 108, 208 and the two second joints 109, 209 are attached to each post, as illustrated in FIG. 4. In the embodiment illustrated in FIG. 4, the second joints 109, 209 are longitudinally slidably assembled to the post 6. In this event, the spacing between the posts could be adjusted even if the two slidable second joints 109, 209 were slidably fitted into one guide groove formed in the post 6.

However, when the two second joints 109, 209 are slidably fitted into the guide grooves 54, 55, separately formed in the post 6, respectively, as illustrated in FIG. 4, the two second joints 109, 209 can be freely moved in the longitudinal direction of the post 6 independently of each other, so that one second joint 109 can be positioned at a level lower than, at the same level as, or at a level higher than the other second joint 209 in accordance with the spacing between the posts 6. In this way, the spacing between the posts 6 can be adjusted over a wider range. When the two second joints 109, 209 are slidably fitted in the same guide groove, one is necessarily positioned above the other, so that in some cases the two joints 109, 209 abut to each other to limit an adjustable range of the spacing between the posts. In the embodiment illustrated in FIG. 4, however, such an inconvenience would never occur.

The structure illustrated in FIG. 4 may be applied as well when the second joints are fixed to the post. In essence, either the two first joints or the two second joints longitudinally slidably attached to the associated post may be slidably fitted into guide grooves separately formed in the post, respectively.

As can be understood from the foregoing description, the post 6 is formed with a number of grooves 54, 54A, 55, 55A, 57, 69, extending over the entire length thereof in the longitudinal direction, and the center hole 62. When this post 6 is made of resin or metal and fabricated by extrusion molding, the post 6 having a number of grooves and the central hole 62 can be provided at a low cost. Also, the post 6 having the grooves and center hole as mentioned exhibits high bending stiffness and torsion modulus, thereby making it possible to enhance the rigidity of the entire article transporting/storing apparatus. As such, each post 6 is desirably made of an extruded material such as metal or resin which has substantially a constant cross-sectional shape over the entire length thereof in the longitudinal direction.

Figure 23:
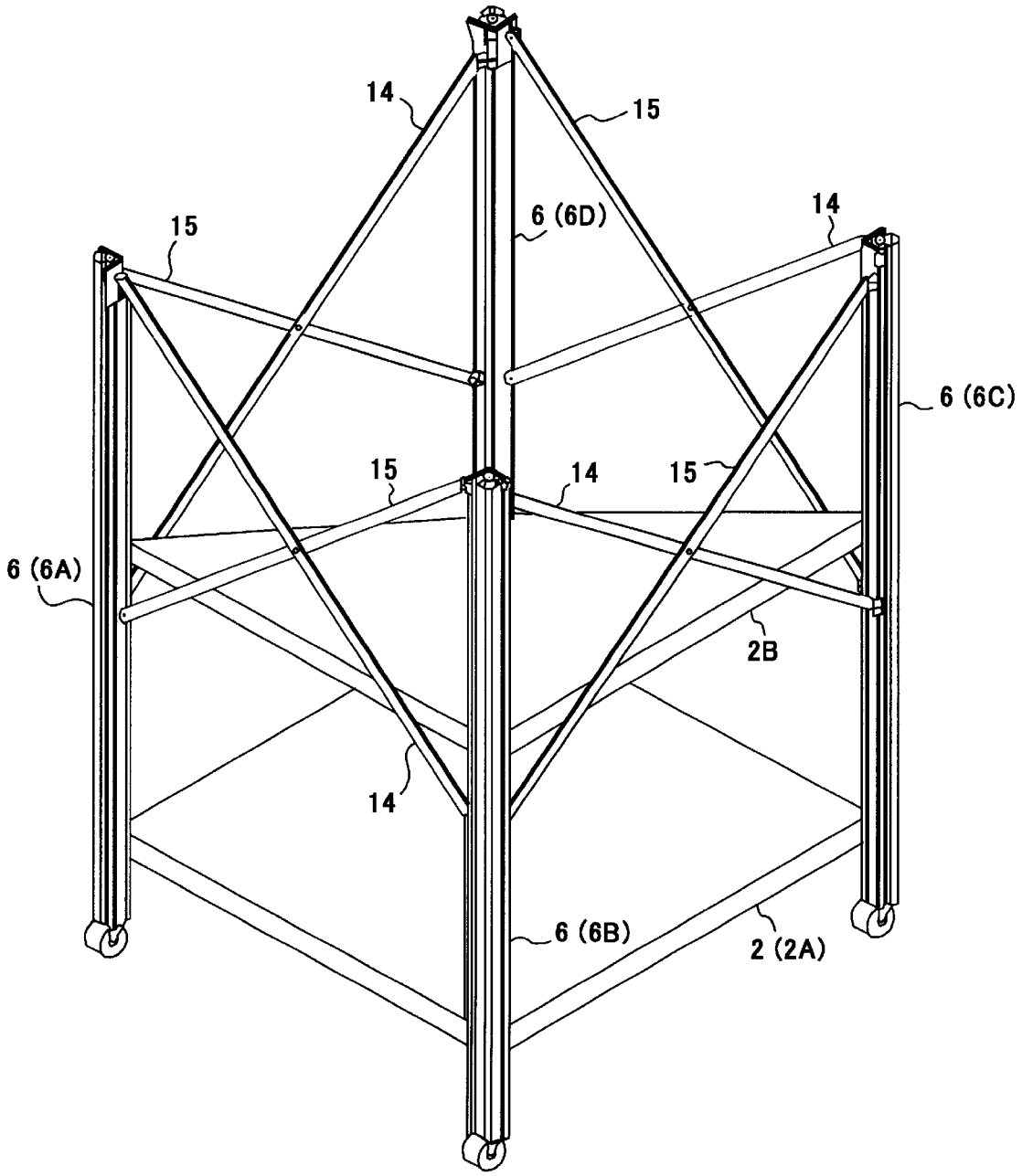
FIG. 23 is a perspective view of an article transporting/storing apparatus which supports an article carrier with three posts.

In the embodiments described above, the article carrier 2 is supported by all of a plurality of posts 6 spaced apart from one another. Alternatively, the article carrier 2 may be supported only by some of the posts 6. For example, as illustrated in FIG. 23, an upper article carrier 2B is formed substantially in a triangular shape, and respective comers thereof are supported by first to third posts 6A, 6B, 6C in a manner similar to the foregoing. In this way, even if an article (not shown) having a height larger than the spacing between the upper and lower article carriers 2A, 2B is placed on the lower article carrier 2A, it is possible to prevent the upper article carrier 2B from interfering with the article.

As described above, the article carrier is supported by at least some of a plurality of posts. However, the article carrier is supported preferably by two or more posts and more preferably by three or more posts in order to support the article carrier with a higher stability.

In the foregoing embodiments, a plurality of types of article carriers 2 having different lengths of sides from one another have been provided, such that an appropriate article carrier 2 is selected in accordance with the size, form, etc. of articles 1 to be transported, and the spacings between the posts 6 are adjusted to accommodate the size. For allowing a variety of articles different in size and form to be transported in this way, a variety of article carriers having different sizes from one another must be previously provided.

In contrast, if the article carrier 2 is made adjustable in dimension to change its profile, a single article carrier 2 may be adjusted in dimension to carry thereon articles of different size, form or number, thereby making it possible to reduce the number of previously provided article carriers, or to carry or store a number of different types of articles only with a single type of article carriers 2. In the following, specific embodiments of such article carriers will be described.

An article. carrier 2 illustrated in FIG. 24 has four, i.e., first to fourth carrier members 103A, 103B, 103C, 103D, and guide rods 24A, 25A, 24B, 25B, 24C, 25C, 24D, 25D for coupling the carrier members in a manner described below. These carrier members and guide rods are made of a highly rigid material, for example, metal, hard resin, wood or the like. Upper surfaces of the carrier members serve as a article carrying surface 5 for carrying articles 1 (FIG. 1). Each carrier member has two legs 4A, 4B, 4C or 4D. A positioning hole 22 is formed in a lower end portion of the leg.

The adjacent first and second carrier members 103A, 103B are coupled to each other through a pair of guide rods 24A, 25A extending in parallel with each other. One of the guide rods 24A has a proximal end 29A fixed to the second carrier member 103B, and its free end 28A slidably fitted in a hole formed in the first carrier member 103A. Likewise, the other guide rod 25A has its proximal end 37A fixed to the first carrier member 103A, and its free end 31A slidably fitted in a hole formed in the second carrier member 103B.

Similarly, the adjacent second and third carrier members 103B, 103C are coupled to each other through a pair of guide rods 24B, 25B extending in parallel with each other. One of the guide rod 24B and the other guide rod 25B have their proximal ends 29B, 37B fixed to the second and third carrier members 103B, 103C, respectively, and their free ends 28B, 311B slidably fitted in holes formed in the third and second carrier members 103C, 103B, respectively. These guide rod 24B, 25B extend in a direction orthogonal to the aforementioned guide rods 24A, 25A.

Further, the adjacent third and fourth guide members 103C, 103D are also coupled to each other through a pair of guide rods 24C, 25C extending in parallel with each other. The guide rods 24C, 25C have their proximal ends 29C, 37C fixed to the fourth and third carrier members 103D, 103C, respectively, and their fee ends 28C, 31C slidably fitted in holes formed in the third and fourth carrier members 103C, 103D, respectively. These guide rods 24C, 25C extend in parallel with the aforementioned guide rods 24A, 25A.

Similarly, the adjacent fourth and first carrier members 103D, 103A are also coupled to each other through a pair of guide rods 24D, 25D extending in parallel with each other. The guide rods 24D, 25D have their proximal ends 29D, 37D fixed to the fourth and first carrier members 103D, 103A, respectively, and their free ends 28D, 3 1D slidably fitted in holes formed in the first and fourth carrier members 103A, 103D, respectively. The guide rods 24D, 25D extend in parallel with the aforementioned guide rods 24B, 25B and in a direction orthogonal to the aforementioned guide rods 24A, 25A, 24C, 25C.

Figure 25:
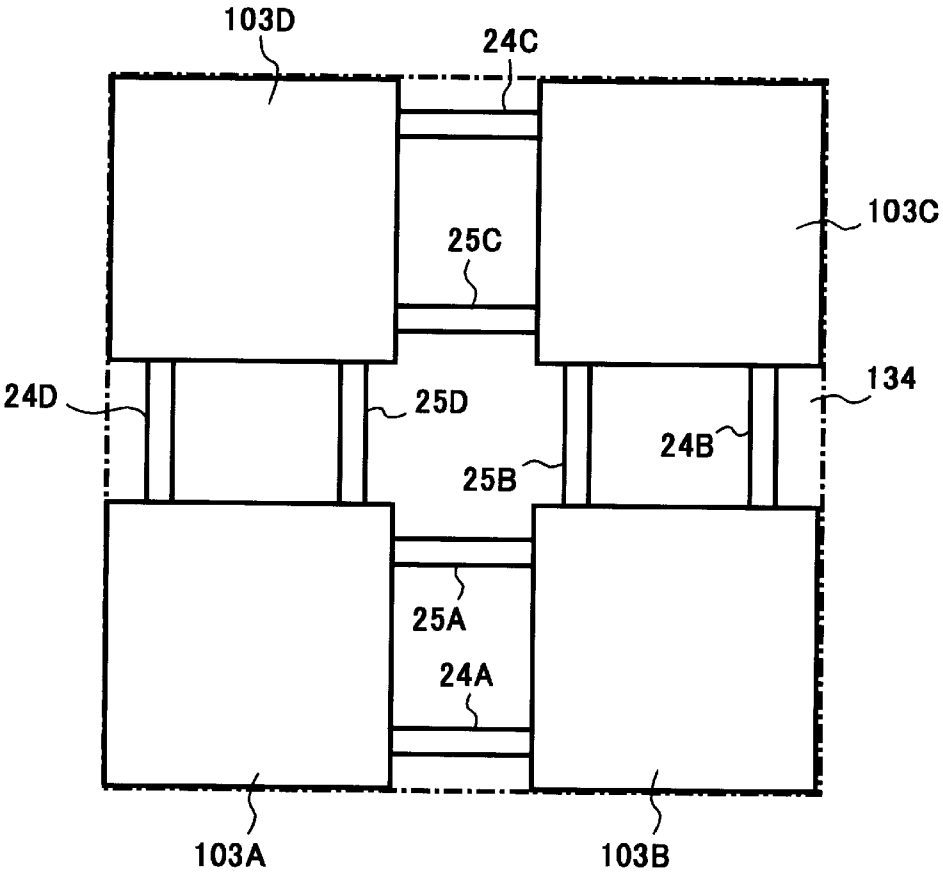
FIG. 25 is a plan view for explaining the profile of the article carrier.

As described above, the four carrier members 103A, 103B, 103C, 103D are positioned adjacent to one another, with their upper surfaces being substantially coplanar, so that when these carrier members are set up on a horizontal surface such as a floor surface, the upper surfaces of the respective carrier members are also horizontal and serve as an article carrying surface 5. As schematically indicated by one-dot chain lines in FIG. 25, a rectangular profile 134 is formed by outer edges of the respective carrier members.

Figure 26:
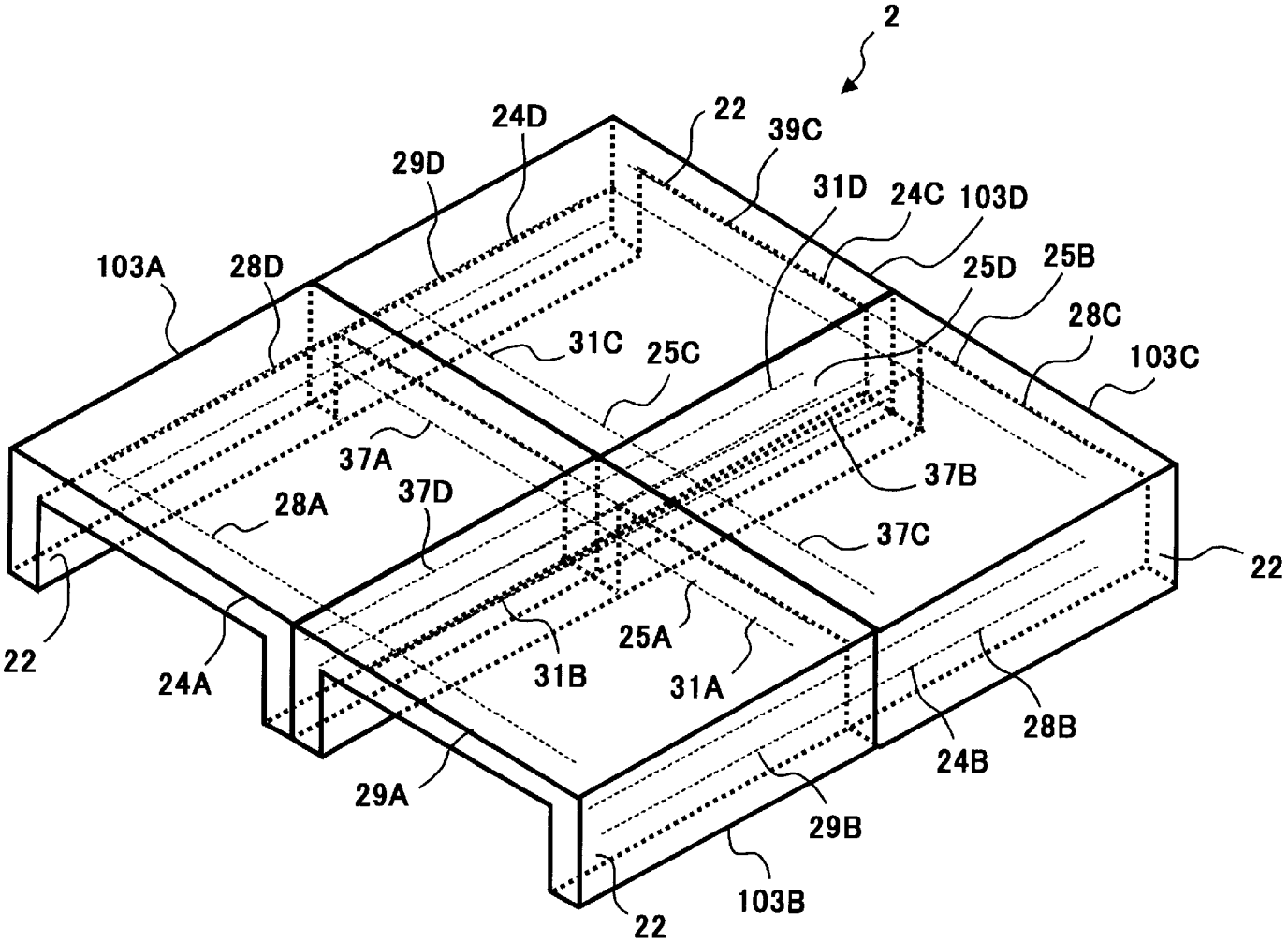
FIG. 26 is a perspective view of the article carrier illustrated in FIG. 24 when it is maximally reduced in size.

Here, as the adjacent carrier members are pressed in a direction in which they are brought closer to one another, the carrier members approach to each other as guided by the respective guide rods, and eventually, the adjacent carrier members abut to each other, as illustrated in FIG. 26. In this event, the profile 134 (FIG. 25) of the article carrier 2 formed by the outer edges of the respective carrier members is smaller than that illustrated in FIG. 24. Conversely, as the adjacent carrier members are pressed in a direction in which they are separated further away from one another, the carrier members are largely spaced apart from one another as guided by the respective guide rods, as illustrated in FIG. 24, in which case the profile 134 is larger than that illustrated in FIG. 26.

Figure 27:
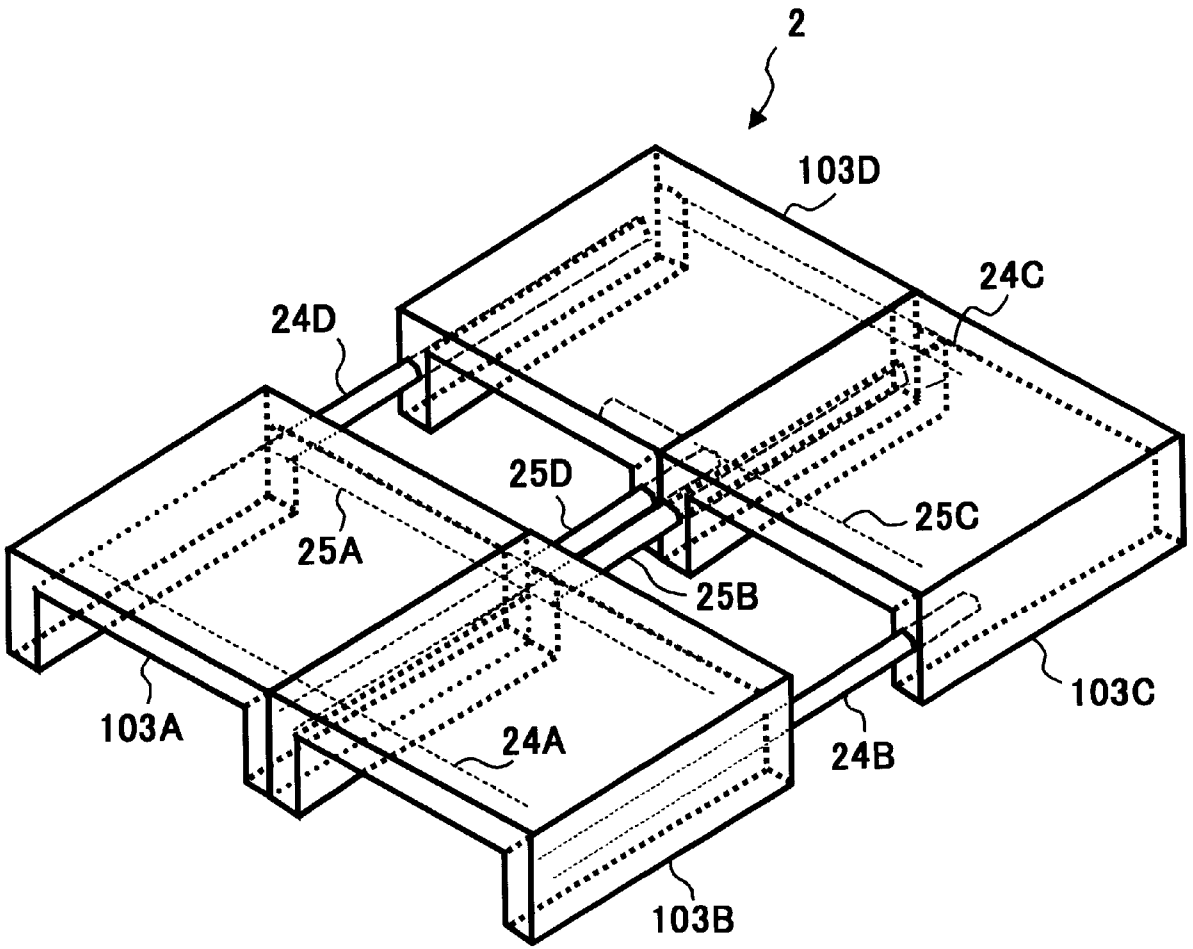
FIG. 27 is a perspective view of the article carrier when a pair of carrier members are separated from another pair of carrier members.

Alternatively, as illustrated in FIG. 27, the first and second carrier members 103A, 103B abutting to each other, and the third and fourth carrier members 103C, 103D likewise abutting to each other may be spaced apart from each other. Further, though not shown, the first and fourth carrier members 103A, 103D abutting to each other, and the second and third carrier members 103B, 103C abutting to each other may be spaced apart from each other as well.

The guide rods constitute an example of carrier member coupling means which couples the respective carrier members for movements relative to one another.

Figure 24:
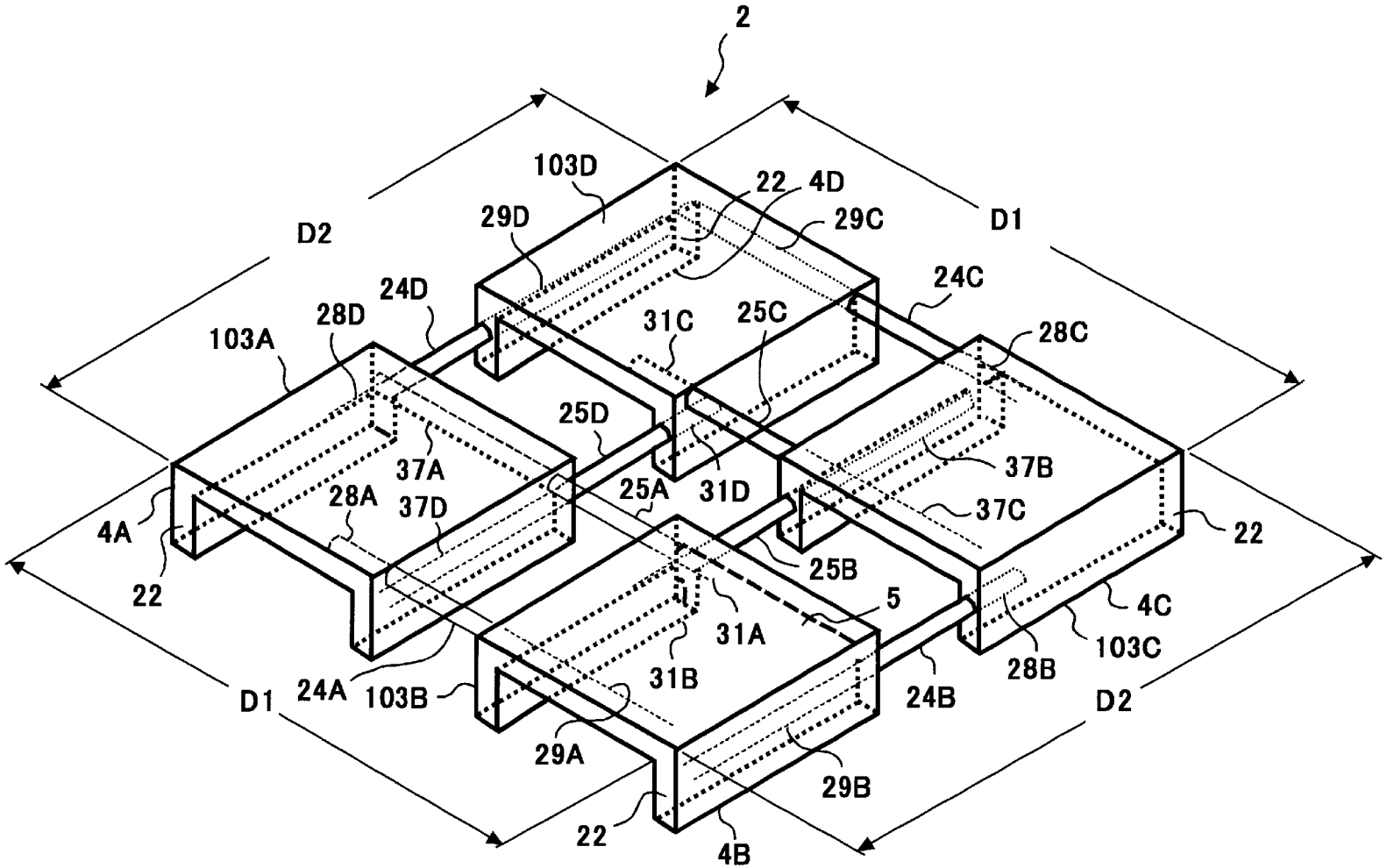
FIG. 24 is a perspective view illustrating an exemplary article carrier, the profile of which can be extended and contracted.

As described above, the article carrier 2 is configured to allow for adjusting the size of the profile 134, whereby the profile 134 of the article carrier 2 can be extended as illustrated in FIG. 24 for carrying a large article 1 or a number of articles 1 on the article carrier 2, and the profile 134 of the article carrier 2 can be reduced as illustrated in FIG. 26 or 27 on the contrary when small articles 1 are carried.

The size of the article carrier 2 is freely changed in accordance with the size and form of an article (articles) 1 to be transported or stored, and the spacings between the adjacent posts 6 are adjusted in accordance with the lengths D1, D2 of the respective sides of the resulting article carrier 2 as described above. The article carrier 2 is attached to the respective posts 6 after the adjustment. In this way, a variety of sizes or variety of forms of articles 1 can be carried on the single article carrier 2 for transportation or storage, thereby eliminating the previous provision of a large number of article carriers 2 in a variety of sizes corresponding to the size, form or number of particular articles.

Figure 28:
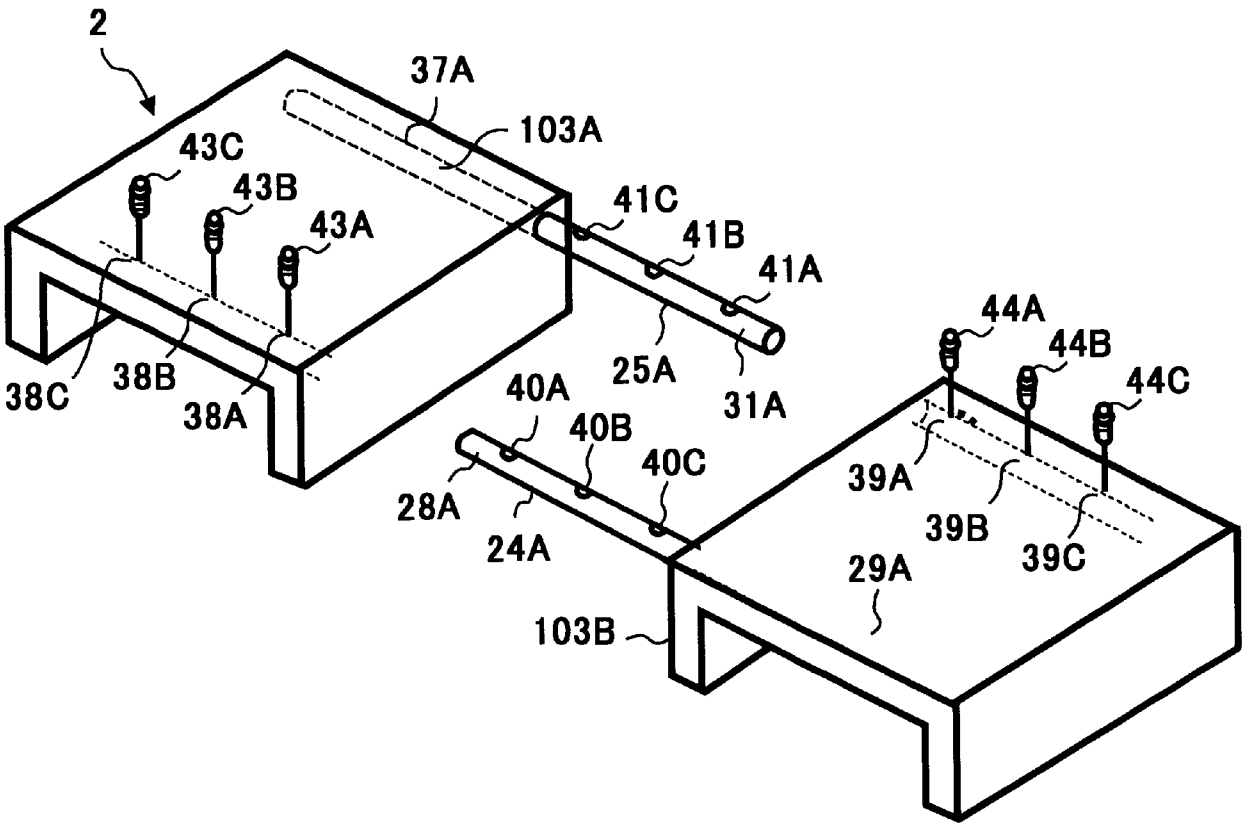
FIG. 28 is a perspective view illustrating exemplary fixing means for fixing carrier members to each other.

The article carrier 2 also has fixing means for fixing a plurality of carrier members to prevent the plurality of carrier members from moving relative to one another after the sides of the article carrier 2 have been adjusted in length. FIG. 28 illustrates an example of the fixing means. hi FIG. 28, first and second carrier members 103A, 103B are formed with a plurality of screw holes 38A, 38B, 38C; 39A, 39B, 39C, respectively, which communicate with holes in which free ends 28A, 31A of the guide rods 24A, 25A are slidably fitted. The respective guide rods 24A, 25A are formed with a plurality of locking holes 40A, 40B, 40C; 41A, 41B, 41C, respectively.

As illustrated in FIG. 24, when the first and second carrier members 103A, 103B are largely separated from each other, the screw hole 38A of the first carrier member 103A is in alignment with the locking hole 40A of the guide rod 28A, and the screw hole 39A of the second carrier member 103B is in alignment with the locking hole 41A of the guide rod 25A. In this state, screws 43A, 44A are screwed into the screw holes 38A, 39A, respectively, such that the leading ends of the screws 43A, 44A are fitted into the locking holes 40A, 41A, respectively. In this way, the first and second carrier members 103A, 103B are firmly fixed at the positions illustrated in FIG. 24.

When the first and second carrier members 103A, 103B are brought closest possible to each other as illustrated in FIG. 26, all the screw holes 38A, 38B, 38C and 39A, 39B, 39C are in alignment with the locking holes 40A, 40B, 40C and 41A, 41B, 41C, respectively. In this state, at least one of the screws 43A, 43B, 43C and at least one of the screws 44A, 44B, 44C are screwed into the associated screw holes, and the leading ends of the screws are engaged with the associated locking holes.

This engagement causes the first and second carrier members 103A, 103B to be securely coupled to each other in the state illustrated in FIG. 26. When the first and second carrier members 103A, 103B are placed between the positions illustrated in FIGS. 24, 26, and the screws 43A, 43B; 44A, 44B are screwed into the screw holes 38A, 38B; 39A, 39B which are in alignment with them at this time, the carrier members 3A, 3B may be fixed at this position. The remaining adjacent carrier members can also be securely fixed to each other in a manner similar to the foregoing. The respective carrier members can be again moved relative to each other by loosening the screws.

Figure 29:
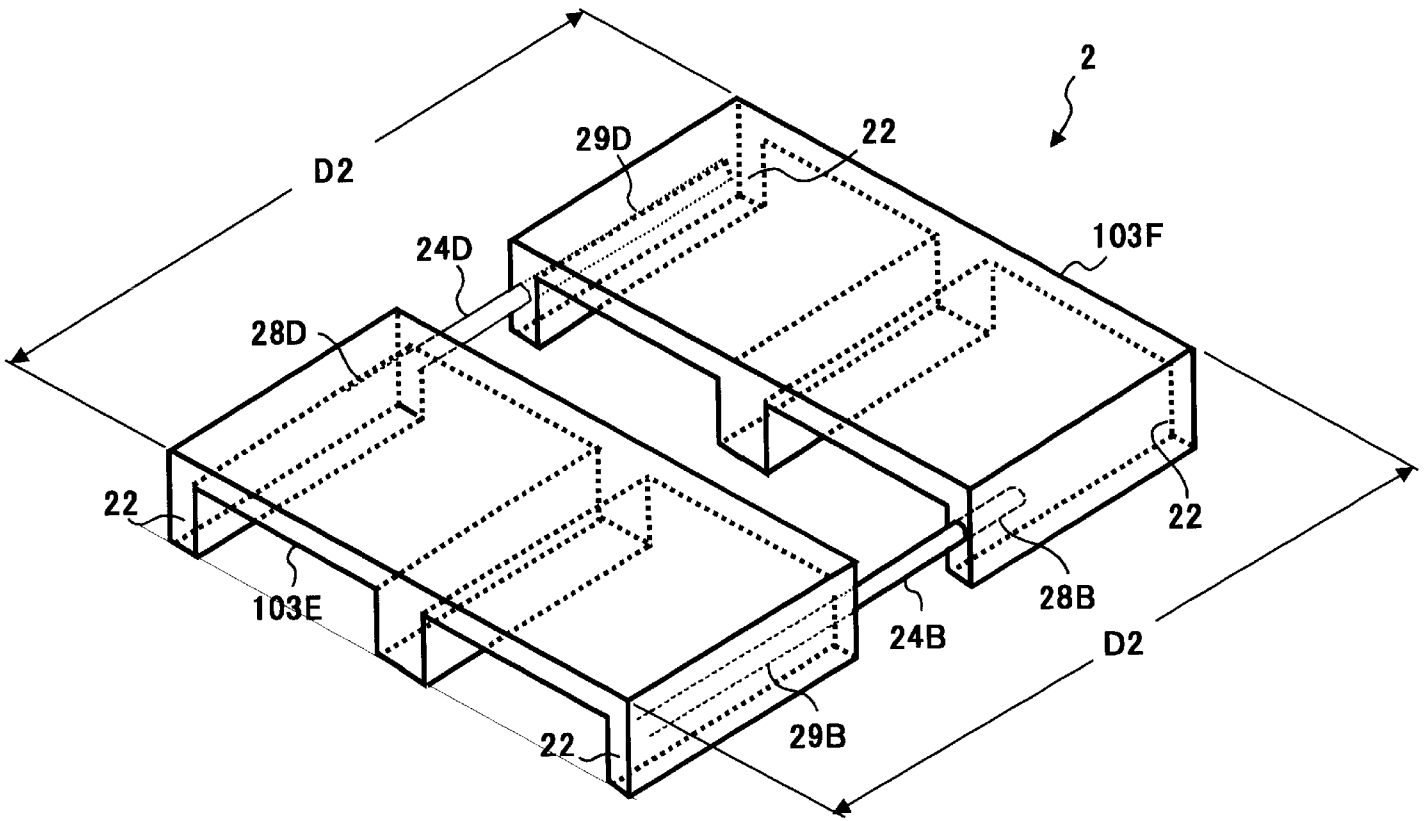
FIG. 29 is a perspective view illustrating another extensible and contractible article carrier.

Also, as illustrated in FIG. 29, the article carrier 2 may comprise two carrier members 103E, 103F and a plurality of guide rods 24B, 24D, which comprise exemplary carrier member coupling means for coupling the carrier members 103E, 103F to allow the carrier members 103E, 103F to move relative to each other in directions in which they approach to each other and they are separated from each other. These guide rods 24B, 24D are configured completely in the same manner as the guide rods 24B, 24D illustrated in FIG. 24.

The foregoing structure also allows for adjusting the length D2 of one side of the article carrier 2 by bringing the two carrier members 103E, 103F closer to or further away from each other.

As described above, the article carrier 2 illustrated in FIGS. 24 to 29 are configured such that at least two sides thereof, i.e., one side and the side opposing the one side can be adjusted in length.

When the article carrier is configured such that the lengths of its sides can be adjusted, the article carrier may be fixed to the respective posts 6 so that it cannot be removed in a normal state, in which case the spacings between the posts and the lengths of the sides of the article carrier are adjusted at the same time.

Alternatively, the foregoing article transporting/storing apparatus may be configured such that the respective posts can be extended and contracted in the longitudinal direction to adjust the length of the respective posts in accordance with the height of articles to be transported. For example, the posts may be formed of a plurality of telescopically fitted post members, wherein the post members are fixed to each other with fixing means such as screws after the length has been adjusted.

While exemplary embodiments of the present invention have been described, the present invention is not limited to the structures illustrated in these embodiments, but a variety of modifications and alterations may be made in structure. Also, the foregoing structures may be combined as appropriate. In addition, the present invention can be widely applied to any apparatus for transporting or storing substantially any article such as a variety of products other than printers, natural products, etc.

Numerous additional modifications and variations of the present application are possible in light of the above teachings. It is therefore to be understood that within the scope of the appended claims, the present application may be practiced otherwise than as specifically described herein.

What is claimed as new and is desired to be secured by Letter Patent of the U.S. is:

1. An article transporting/storing apparatus, comprising:

a plurality of posts;

a post coupling mechanism arranged and configured to couple adjacent posts to each other such that at least one spacing between said posts is adjustable;

at least one article carrier supported by at least two of said plurality of posts; and a carrier holding mechanism supported by said posts, said article carrier being supported by said carrier holding mechanism, wherein said carrier holding mechanism includes a carrier pressing member removably fixed to said post and configured to press an upper surface of said article carrier.

2. An article transporting/storing apparatus according to claim 1, wherein said carrier holding mechanism is configured to hold said article carrier at different positions in a longitudinal direction of said posts.

3. An article transporting/storing apparatus according to claim 1, wherein said article carrier is removably attached to said posts.

4. An article transporting/storing apparatus according to claim 2, wherein said carrier holding mechanism includes a carrier receiving member removably fixed to said post, said carrier receiving member supporting said article carrier from below.

5. An article transporting/storing apparatus according to claim 1, further comprising a positioning mechanism configured to position said article carrier with respect to said post.

6. An article transporting/storing apparatus according to claim 1, wherein said article carrier is adjustable such that a profile thereof is changed.

7. An article transporting/storing apparatus, comprising:

a plurality of posts;

a post coupling mechanism arranged and configured to couple adjacent posts to each other such that at least one spacing between said posts is adjustable; and at least one article carrier supported by at least two of said plurality of posts, wherein said article carrier is adjustable such that a profile thereof is changed, and wherein said article carrier includes a first carrier member adjustably connected to a second carrier member by a guide rod, said guide rod being connected to said first carrier member and slidably received within a guide hole in said second carrier member.

8. An article transporting/storing apparatus according to claim 7, wherein said second carrier member includes first locking holes configured to communicate with said guide hole, said guide rod having second locking holes configured to align with said first locking holes, said first locking holes and said second locking holes being configured to receive a locking member such that said guide rod is fixed within said guide hole.

9. An article transporting/storing apparatus according to claim 1, wherein said post coupling mechanism includes a first coupling member having a first end pivotally connected to a first of said adjacent posts and a second end slidably and pivotally connected to a second of said adjacent posts, said post coupling mechanism further includes a second coupling member having a first end pivotally connected to said second of said adjacent posts and a second end slidably and pivotally connected to said first of said adjacent posts, a central portion of said first coupling member being pivotally connected to a central portion of said second coupling member.

10. An article transporting/storing apparatus, comprising:

a plurality of posts;

post coupling means for coupling adjacent posts to each other such that at least one spacing between said posts is adjustable;

at least one article carrier supported by at least two of said plurality of posts; and carrier holding means for supporting said article carrier on said posts, wherein said carrier holding means includes a carrier pressing member removably fixed to said post for pressing an upper surface of said article carrier.

11. An article transporting/storing apparatus according to claim 10, wherein said carrier holding means is adapted to hold said article carrier at different positions in a longitudinal direction of said posts.

12. An article transporting/storing apparatus according to claim 10, wherein said article carrier is removably attached to said posts.

13. An article transporting/storing apparatus according to claim 10, wherein said carrier holding means includes a carrier receiving member removably fixed to said post for supporting said article carrier from below.

14. An article transporting/storing apparatus according to claim 10, further comprising positioning means for positioning said article carrier with respect to said post.

15. An article transporting/storing apparatus according to claim 10, wherein said article carrier is adjustable such that a profile thereof is changed.

16. An article transporting/storing apparatus, comprising:

a plurality of posts;

post coupling means for coupling adjacent posts to each other such that at least one spacing between said posts is adjustable; and at least one article carrier supported by at least two of said plurality of posts, wherein said article carrier is adjustable such that a profile thereof is changed, and wherein said article carrier includes a first carrier member adjustably connected to a second carrier member by a guide rod, said guide rod being connected to said first carrier member and slidably received within a guide hole in said second carrier member.

17. An article transporting/storing apparatus according to claim 16, wherein said second carrier member includes first locking holes configured to communicate with said guide hole, said guide rod having second locking holes configured to align with said first locking holes, said first locking holes and said second locking holes being configured to receive a locking member such that said guide rod is fixed within said guide hole.

* * * * *